US009555281B2

(12) United States Patent
Beckman

(10) Patent No.: US 9,555,281 B2
(45) Date of Patent: Jan. 31, 2017

(54) CLIPWEIGHTS

(71) Applicant: Christopher V. Beckman, San Diego, CA (US)

(72) Inventor: Christopher V. Beckman, San Diego, CA (US)

( * ) Notice: Subject to any disclaimer, the term of this patent is extended or adjusted under 35 U.S.C. 154(b) by 634 days.

(21) Appl. No.: 13/709,058

(22) Filed: Dec. 9, 2012

(65) Prior Publication Data

US 2014/0162855 A1 Jun. 12, 2014

(51) Int. Cl.

| | |
|---|---|
| ***A63B 21/00*** | (2006.01) |
| ***A63B 21/072*** | (2006.01) |
| ***A63B 21/065*** | (2006.01) |
| ***A63B 21/075*** | (2006.01) |

(52) U.S. Cl.

CPC ..... *A63B 21/0728* (2013.01); *A63B 21/065* (2013.01); *A63B 21/075* (2013.01); *A63B 21/0726* (2013.01); *A63B 21/4015* (2015.10)

(58) Field of Classification Search

CPC ..... A63B 21/00
USPC ..... 482/106, 107, 108
See application file for complete search history.

(56) References Cited

U.S. PATENT DOCUMENTS

| | | | | |
|---|---|---|---|---|
| 2009/0325769 | A1* | 12/2009 | Miskel | A63B 21/0728 482/107 |
| 2011/0209264 | A1* | 9/2011 | Williams et al. | 2/69 |
| 2011/0224053 | A1* | 9/2011 | Hamilton | A63B 21/0728 482/107 |
| 2014/0256521 | A1* | 9/2014 | Davies, III | A63B 21/0728 482/107 |

* cited by examiner

*Primary Examiner* — Jerome w Donnelly

(57) ABSTRACT

New donning-actuated clips and other fastening and tightening techniques for garments are disclosed. In one aspect of the invention, a garment includes a self-contained fitting and fastening system that, preferably, is reversibly actuated by donning, and therefore requires no additional fastening or fitting step to use—a user need only don the garment in an ordinary fashion. In one embodiment, a lateral tightening and fitting mechanism is provided, which translates donning movements into fitting and fastening force via channeled bands, eliminating lateral play in the garment when worn. In other aspects, the fitting and fastening system is configured to aid in compressing and folding the garment when the system is released and the garment is removed by a user. The techniques of the invention are also applied in the context of sporting garments, such as running shoes, allowing a user to put on well-fitted shoes quickly, with easy entry, and no need for separate lacing or binding steps.

15 Claims, 22 Drawing Sheets

Prior Art

Prior Art

Prior Art

CLIPWEIGHTS

FIELD OF THE INVENTION

The present invention relates to the fields of sporting equipment and apparel.

BACKGROUND

Strength training by athletes to increase muscular and cardiovascular performance has been practiced for millennia. In the sub-field of weight training, a great number of specialized weights have been developed, including both freely moving ("free weights") and machine-fastened and administered weights (weight "machines"). With each of those, and in other strength training areas, force is applied against the force of contraction, or attempted contraction, of muscles, resulting in a training response by the body to maintain or increase muscle strength and/or endurance as an adaptation response.

Free weights have historically included one-piece weights, such as fixed dumbbells and kettle-bells, and adjustable weight sets, such as plate-loading barbells. With plate-loading barbells, typically, weights with a loading aperture (a.k.a., "plates") are threaded onto weight-loading ends of a generally rod-shaped barbell (a.k.a., "the bar"), and are held in place on the bar with the aid of weight "clips" or "collars." Many machines also incorporate plate-loading bars, which may benefit from the stability and safety of fixing the weights in place with such clips or collars. Generally, plate-loading bars are used in most advanced strength training programs because the ability to vary the weight loaded in a wide variety of increments on a variety of bars affords the most custom-fitted workout options with the least amount of gear, and storage space.

Plate-fastening weight clips have been developed in a variety of forms, as shown in related art FIGS. 9-12, and typically require several steps to deploy, such as, but not limited to: 1) loosen each clip; 2) slide each clip over a bar; 3) fasten each clip in place after sliding; 4) test the clip/weight for lateral play and security against lateral force; 5) adjust the tightness and lateral play of each clip, if necessary; and 6-8) reverse steps 1-3 to unload. As shown in FIG. 9, some clips include threading, such as inner lining threading 901 of clip 905, and work in conjunction with the complementary threading of the bar, for example, the examples of threading shown as 903, to tighten against a loaded plate and secure it in place on a bar. While, in the inventor's experience, the security of this type of clip may be relatively good, if correctly deployed, the inventor also finds that the loading times for changing out weight plates can be onerous in comparison to other clip types. Pin-pressure style weight clips, such as that illustrated in FIG. 10, also use threading, such as that shown as threading 1003, to fasten a collar, such as 1001, to a bar (not pictured) using complementary hole 1005 to drive a pin 1007 toward the center of the bar-holding port 1009 (and, therefore, against the bar, when inserted into a loading aperture of the collar). In the inventor's experience, time delay with that approach also may be great, and he also finds that the holding force of the pins can be weaker and subject to failure or tightening errors due to their relatively small contact area with the bar, in conjunction with non-tightness oriented resistance from a variety of sources, some of which are related to subtle rotational shifts in the collar on the bar. In other words, the inventor has discovered that these weight clips often feel tightened onto the bar when, in fact, they are still loose and poorly seated, and that they require lateral force toleration tests during use to ensure proper seating. The inventor has discovered that other clips, such as the handled spring coil weight clip (an example of which is given as FIG. 11), and the arm-actuated clamping weight clip (provided as FIG. 12), can be faster to attach, but still require the step of sliding a collar onto a bar, after sliding a plate weight on, and have limited fastening power and are more prone to loosen and break, especially from repeated use. These approaches each include actuating handle(s), 1101 and 1201, respectively, with which the user first widens the clip aperture (1103 and 1203) by moving the handles in the directions indicated by motion arrows 1105 and 1205 prior to sliding the clip on after sliding a separate plate-style weight onto a bar. A user then tightens the aperture in place on the bar with reversed handle movements (which may be aided by spring resiling, in the instance of a coil clip).

The inventor has discovered that the utility of all current weight clips can be frustrated by the need to locate and administer them. In the inventor's experience, weight clips may be borrowed, broken or worn—often unevenly, in comparison to one another. The inventor has found that, even within a single professional gym, different age, condition and types of clips may be found, and clips may have widely-differing weights, from anywhere from a few ounces to several pounds. The differing weights of varying clip types have made planning workouts and plotting progress more difficult for the inventor. The inventor has experienced still other disadvantages of present clips, including a tendency for lateral slippage due to an absence of significant active lateral force applying aspects.

None of the statements concerning prior art issues and limitations in the background section of this application are admissions that those statements or their subject matter are prior art. Rather, some information provided herein is the result of the inventor's personal experience and research, and is included in the background section to provide foundational information that may be helpful in understanding aspects of the invention set forth in this application. Thus, the "Background" heading refers to foundational information, some of which may or may not be prior art.

This application sets forth a variety of examples of aspects of the present invention, which are illustrative, not exhaustive, of the even wider variety of potential implementations. It should be understood that a virtually unlimited number and degree of alternative embodiments, including alternative systems and methods and parts thereof, even though not specifically set forth, fall within the scope of the invention.

It should also be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

SUMMARY OF THE INVENTION

New weight clipping techniques, including devices, systems and methods, are disclosed. In one aspect of the invention, plate-style weights themselves include a clipping mechanism that, preferably, is reversibly weight-actuated, and therefore requires no additional clipping step to use—a user need only load a weight-actuated, self-clipping plate. In other aspects of the invention, the barbell may contain a clipping mechanism and a lateral tightening and securing mechanism in the direction of loading, eliminating lateral play. In still other aspects, a user may rapidly, selectively shed weight from a weight-loading member. The weight and other internal-force-actuated tightening aspects are also applied in the context of running shoes and apparel, allowing a user to put on well-fitting shoes and other clothing quickly, with easy entry, and no need for separate lacing or binding steps.

DETAILED DESCRIPTION OF THE INVENTION

Figure 1:
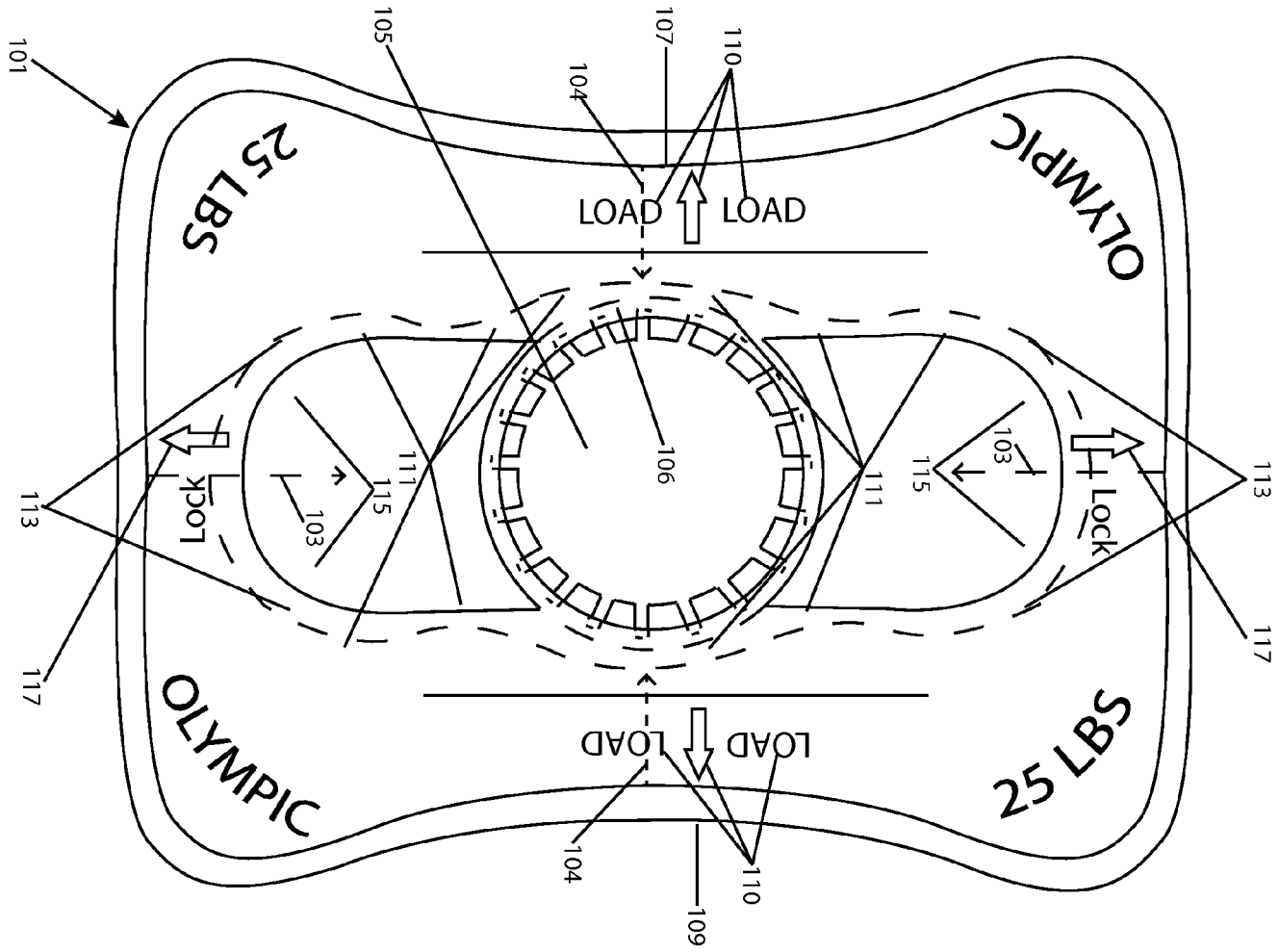
FIG. 1 is a side view illustrating an integrated weight-actuated CLIP-WEIGHT, in accordance with aspects of the present invention.

FIG. 1 is a side view illustrating an integrated self-securing, weight-actuated CLIP-WEIGHT 101, in accordance with aspects of the present invention. In the illustration provided in FIG. 1, which is exemplary, not exhaustive, of some aspects of the present invention, the CLIP-WEIGHT 101 generally has bilateral symmetry, on each side of plane indicating rays 103 and 104. This bilateral symmetry aids a user in loading, unloading, securing and unsecuring the CLIP-WEIGHT unit from a barbell (not pictured). To load the CLIP-WEIGHT onto a barbell, the user places semi-flexible port 105 and port-defining ring 106 onto the bar with either edge/side 107 or edge/side 109 facing directly upwards or downwards as shown to the user by guiding signage 110. The user may hold the CLIP-WEIGHT in this position while sliding it into its desired locking position on the bar—normally, as far as possible before colliding with a containing wall of the barbell loading area or another weight already loaded onto the bar (not pictured). At that point, the user may manually rotate the CLIP-WEIGHT, or allow it to rotate, due to gravity, 90 degrees clockwise or counterclockwise, leading the CLIP-WEIGHT in general to move downward, and semi-flexible port 105 and port-defining ring 106 to slide upward in curved port channel 111, and to lock into one of notches 113, pushed by the bar relative to the remainder of the moving weight, which bar also moves upward in its own complimentary, outwardly visible channel and notch 115. In its relaxed state, at the center of the CLIP-WEIGHT (pictured), unloaded onto a bar, semi-flexible port 105 and defining ring 106 are substantially circular, due to incorporation of an elastomeric, plastic or other resilient, flexible material comprised in ring 106. However, as semi-flexible port 105 and defining ring 106 ease into their channel 111 while being locked onto a bar, the natural narrowing and locking notch shape 113 which the channel flows into leads the CLIP-WEIGHT to compress port—defining ring 106 onto the bar, locking it into position onto the bar due to its resulting narrowing of port 105.

In practice, a manual rotation of the CLIP-WEIGHT to achieve locking in position on the bar, with a rotational position of the CLIP-WEIGHT shown in FIG. 1, and one of locking position indicators 117 pointing upwards, will not be required, because the CLIP-WEIGHT will naturally lose balance, tipping against and away from the loading rotational position and into the locking rotational position (pictured) with the aid of gravity bringing one of the channels 111 and notches 115 to bear against the bar. To unload the CLIP-WEIGHT, a user may simply turn the CLIP-WEIGHT 90 degrees in either rotational direction, returning it to the loading rotational position, and slide the port 105 and ring 106 to its former, central position, and then slidingly remove the CLIP-WEIGHT.

Figure 2:
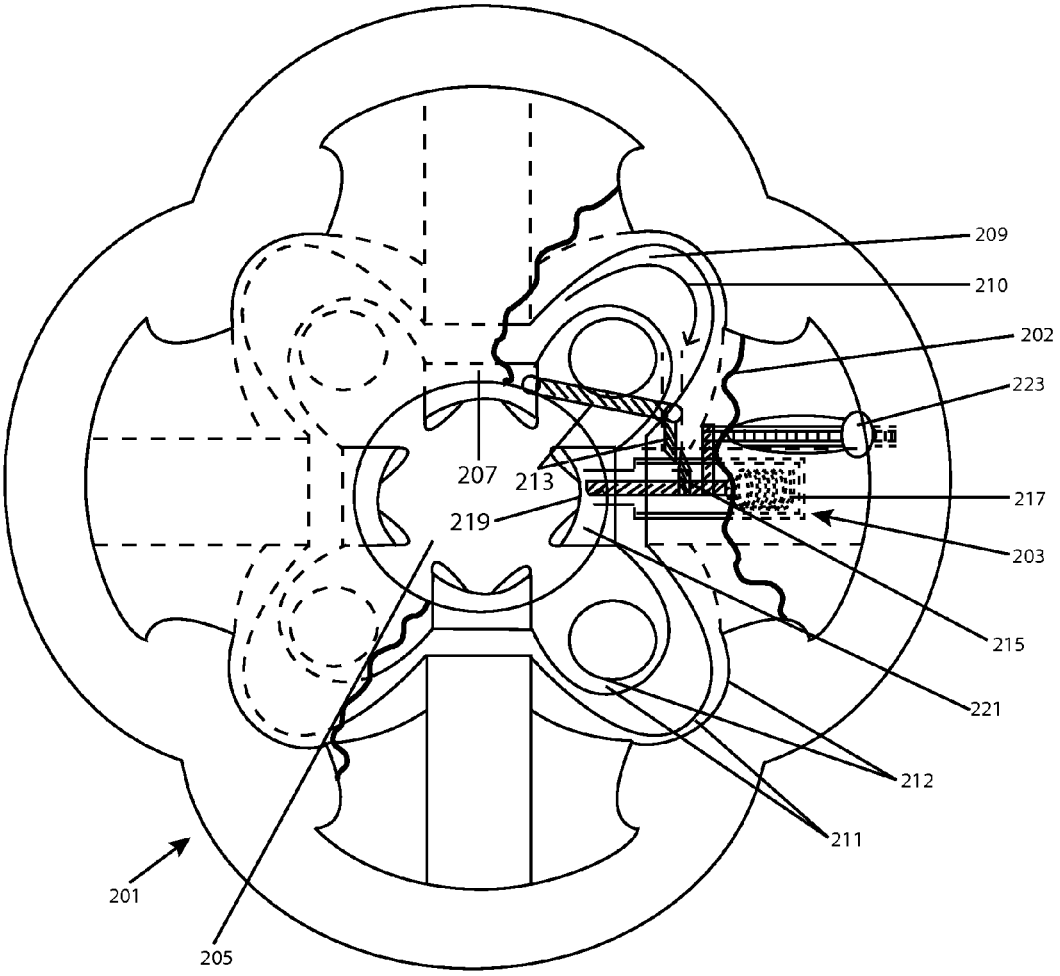
FIG. 2 is a side view illustration of another integrated self-securing and -releasing, weight-actuated CLIP-WEIGHT, in accordance with aspects of the present invention.

FIG. 2 is a partial depiction of another integrated self-securing and releasing weight-actuated CLIP-WEIGHT 201, in accordance with aspects of the present invention. In the embodiment provided in FIG. 2, which is exemplary, the CLIP-WEIGHT has radial symmetry, with several substantially identical sections. For simplicity, a detailed illustration of just one of four operating mechanisms 203 is provided, and partly revealed through a cut-away section 202 in an outer housing. The actual CLIP-WEIGHT used may alternatively contain two or more such operating mechanisms, positioned 90 degrees or in other evenly-spaced or unevenly-spaced rotational position separations from one another, as shown, for example, with the different operating mechanisms shown in FIG. 3, discussed below. However, in one aspect of the present invention, just one mechanism, as shown in FIG. 2, or two mechanisms in 180 degree opposition (not pictured), may be provided.

CLIP-WEIGHT 201 may be placed onto a bar (not pictured) in the orientation pictured by slipping port 205 over one of the bar's loading ends. As this occurs, in the orientation shown, the weight of the CLIP-WEIGHT will naturally push button/holder 207 upward. Button/holder 207 is in communication with flexible, curved pushing band 209, which moves as shown by motion arrow 210 within channel 211, defined by guiding walls 212. In addition, the upward motion of button/holder 207 upwardly moves a connected locking piece 213, guided by interfacing grooves, such as 214, releasing an interlocking piece 215, which, in turn, releases stored energy from a stored energy source 217 (such as a loaded spring). The then-released energy source 217 then pushes tightening piece 219, which, in turn, pushes member 221 inward, securing, gripping and/or locking onto the bar.

When an exercise has been completed, a user may disengage CLIP-WEIGHT 201 by aid of release switch 223 which, preferably, may use leverage or gearing to aid storing energy again in source 217, e.g., by locking a spring into a compressed position with the aid of locking pieces 213 and 215, which may then return to the interlocking positions pictured. The natural rebound of a force bias, such as another spring (not pictured) or pushing strip such as 209 into the position shown in FIG. 1 may lead piece 213 to return to its original locking position, holding piece 215.

Figure 3:
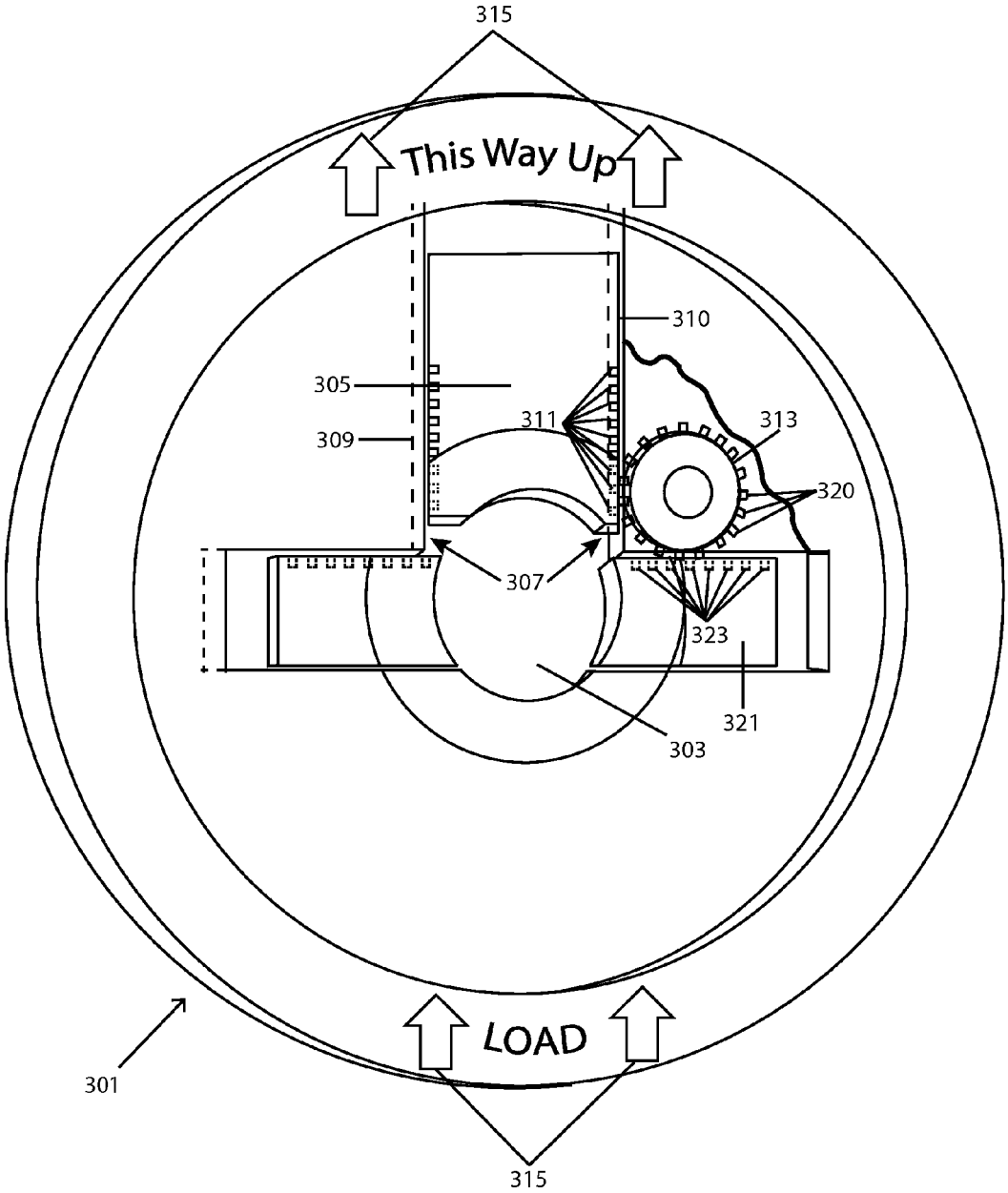
FIG. 3 is a perspective view of another integrated self-securing and -releasing, weight-actuated CLIP-WEIGHT, in accordance with aspects of the present invention.

FIG. 3 illustrates a perspective view of aspects of another integrated self-securing and -releasing, weight-actuated CLIP-WEIGHT, in accordance with aspects of the present invention. A CLIP-WEIGHT system 301 is shown, including a loading aperture, 303, through which a weight-loading member, such as, but not limited to, the end of a barbell, may be threaded for mounting the CLIP-WEIGHT 301. As the CLIP-WEIGHT 301 is loaded, in the orientation pictured, a load-driving member 305 is driven upward against such a member by gravity, in a housing and guiding slot 307. Preferably, complementary grooves on the outer surfaces of both 305 and 307 ensure seating and lateral support of member 305 within slot 307. Among other features, member 305 may comprise generally slot-facing side-walls 309 and 310, at least one of which, as shown with 310, may further comprise rail or gearing features, such as that shown as teeth or teeth-accepting features 311, rendering it a rail capable of accepting a gear. Abutting gear or sprocket 313 may interface with side-wall 310 and features 311 by passing through a window in the side-wall of slot 307 facing side wall 310, allowing teeth on gear 313 to move freely through such a window and interface with rail 310. As member 305 and its sub-features 311 are driven upwards after loading the CLIP-WEIGHT in the orientation shown on FIG. 3, and directed by directional signs 315, onto a loading member, such as the end of a barbell, features 311 spin gear 313 by interfacing with its teeth 320 and driving gear 313 clockwise (from the perspective of the figure). Gear or sprocket 313, in turn, may spin an attached axel 314, attached to another gear or sprocket (not pictured), to drive a tightening member(s), but preferably, teeth 320 instead interface with lateral aperture member 321, via its gear or rail features, such as teeth or teeth-accepting features, e.g., 323. As gear 313 is driven to spin in a clockwise direction, assessed facing into the page of the figure, it also causes teeth 320 and interfacing features 323 to drive member 321 inward, toward the center of aperture 303, and tight against the member onto which the CLIP-WEIGHT has been loaded.

Although the embodiment illustrated in FIG. 3 demonstrates the use of one pair of weight-actuated sliding members/rails 305 and 321, it should be understood that any number of weight-actuated, counter-acting reacting rails, aside from such a pairing, is also possible, while still carrying out aspects of the present invention. It should also be noted that any number of reinforcing structural holds, locks and variable-loads may be applied to assist or hold (and preferably, temporarily and reversibly hold) any of the tightening rails and members in place against the bar onto which the CLIP-WEIGHT is loaded. Preferably, three or four members are used to define and assist in actuating the load-mounting aperture, in complimentarily-angled sets, and mechanical translation of force from the top member (driven up by the force of gravity) drives both side or side/bottom members, as applicable, (e.g., in 90 or 120 degrees of separation from the driving, top member, as may be applicable in the particular embodiment selected), and can be driven into a secure position, whereby the entire weight of the CLIP-WEIGHT leads two side members to be locked in place while applying aperture-narrowing, locking pressure on a weight-loading member, preferably, with mechanical advantage increasing the locking pressure, which may be assisted by additional sources of load (e.g., stored in a spring, locking members). Also preferably, this locking mechanism is only reversible and releasable by use of an external switch, automatically shifted into locked position when the CLIP-WEIGHT is fully loaded, but unlockable by a user switching the switch's position. An example of such a lock-releasing switch and mechanism is discussed, for example, with reference to FIG. 2, as release switch 223.

Although illustrations and figures and discussion in this application may have provided exemplary emphasis on barbell and plate weight based weight systems, it should be understood that the fastening, locking and tightening, and vice versa, systems provided are applicable to any scenario of fastening objects with apertures, or even partial apertures (such as notches) to any weight-loading member or protrusion. Thus, aspects of the present invention applies to a wide variety of other fastening arts as well, such as general hardware and sporting fastening applications, as will be seen through other examples discussed in this application.

Figure 4:
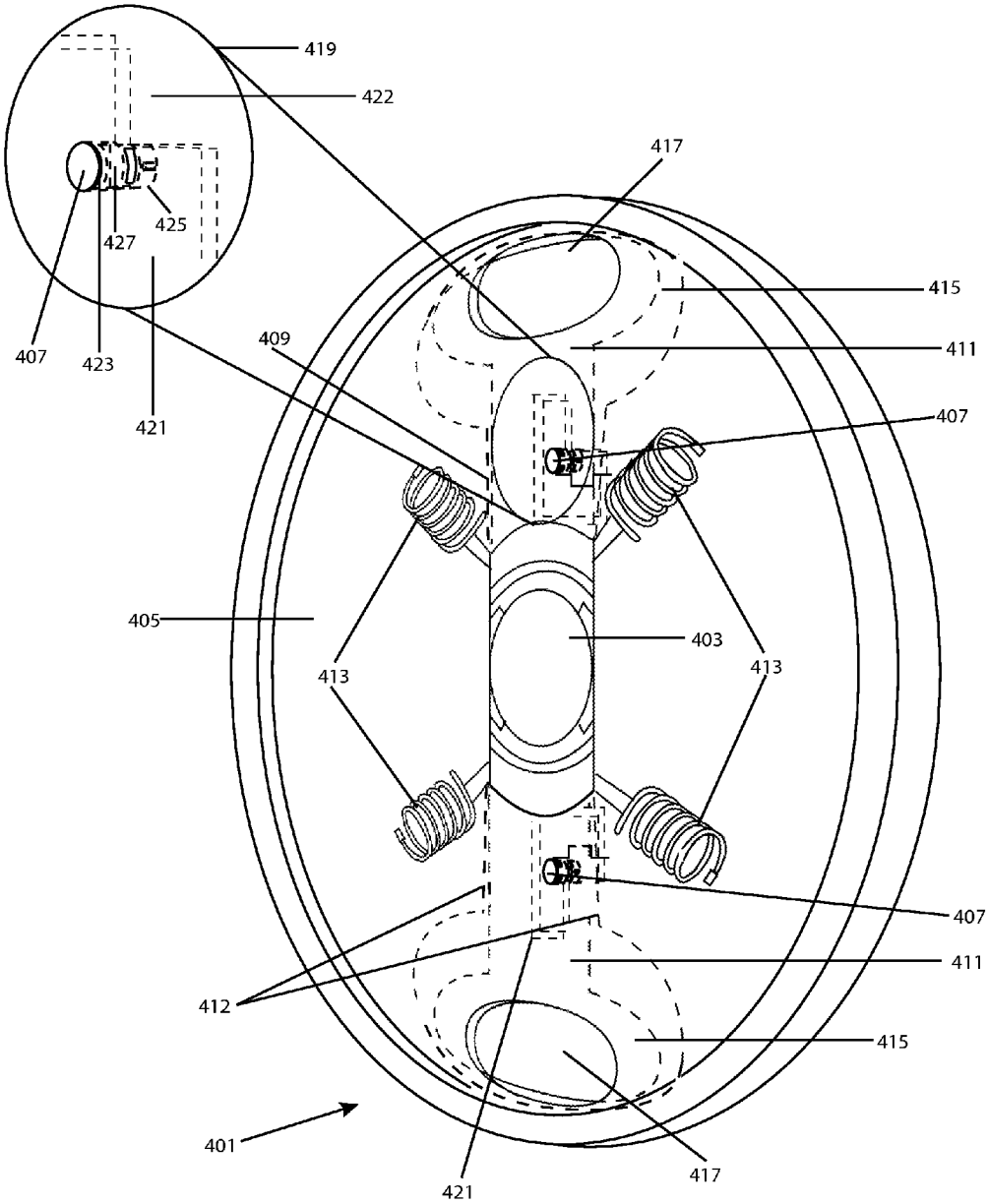
FIG. 4 is a perspective view of an integrated self-securing and -releasing, placement-actuated CLIP-WEIGHT, in accordance with aspects of the present invention.

FIG. 4 is a perspective view of an integrated self-securing and -releasing, placement-actuated CLIP-WEIGHT 401, in accordance with aspects of the present invention. CLIP-WEIGHT 401 may be loaded onto a weight-loading member, such as, but not limited to, the end of a barbell, by threading such a member through aperture 403. To properly complete loading CLIP-WEIGHT 401, it may then be slid along a weight-loading member until one of its two generally flat sides, such as side 405, is pressed against either another plate-shaped weight or a weight-retaining edge or wall attached to or part of the weight-loading member, but which is wider than the surface of the member threaded through aperture. When either of these situations occurs, the CLIP-WEIGHT 401 may be thought of as being in a properly loaded position on the weight-loading member. As CLIP-WEIGHT 401 slides against another weight or the edge or wall attached to or part of the weight-loading member, buttons 407 (which may be on either or both sides of CLIP-WEIGHT 401, and preferably are at least 2 in number, but may be less or more than 2 in number) depress due to contact with either the neighboring plate and/or edge or wall defining the loading position on the weight-loading member. Through an internal mechanism, such as but not limited to a release, buttons 407 may disengage a holding structure between the body 409 of the CLIP-WEIGHT and slidable securing members 411, which are housed within interior channels 412 defined by body 409. Slidable securing members 411 are then driven toward the center of aperture 403 and the weight-loading member threaded within it, securing CLIP-WEIGHT 401 onto the weight-loading member with the assistance of force-exerting stored energy devices, such as but not limited to springs, 413. After the job or exercise requiring the CLIP-WEIGHT to be loaded is completed, the CLIP-WEIGHT may be removed with the aid of member-releasing handles 415 attached to slidable securing members 411. Handles 415 may be physically accessible to a user's hands through handle ports 417. More specifically, a user may pull handles 415 away from the center of the CLIP-WEIGHT and aperture 403, releasing the slidable members 411 from their holding position on the weight-loading member, and then will be able to slide the CLIP-WEIGHT itself away from its loaded position on the weight-loading member, which may also allow buttons 407 to re-emerge (e.g., by spring bias) to an unpressed position, allowing their attached mechanism to re-lock sliding members 411, and the defined aperture 403, into an open position, locking in a loosened aperture 403, as shown in the figure, enabling the further unloading and reloading of CLIP-WEIGHT 401 with no further need to hold handles 415, which are then locked in the open position, as shown.

One possible locking and release mechanism, which may be actuated by buttons 407, which cause the release of members 411 and force-driver tightening of aperture 403 when buttons 407 are depressed by CLIP-WEIGHT 401 colliding with a neighboring weight or another edge of a loading length of a weight-loading member is shown in a zoom window 419. A tab 422 along the inner wall of a notch 421 or hole on the interior of slidable securing members 411 variably permits or limits them from sliding in the force-braced direction, toward tightening aperture 403. If a button 407 is not depressed, an attached inner shaft 423 is in the position shown within a partial sheath 425, and an open section of the wall of sheath 425 then exposes a holding tab which interfaces with, and holds, tab 422. If, however, a button 407 is depressed by mounting collision, inner shaft 423 penetrates sheath 425 more deeply, until a trench 427 is exposed by the hole in the wall of sheath 425, and interfaces with tab 422, allowing it to slide through, and member 411 to tighten aperture 403. Force biasing 427 against inner shaft 423 causes the re-emergence of button 407, if members 411 are retracted again, removing tab 422 from trench 427, and if button 402 is no longer depressed. (e.g., CLIP-WEIGHT 401 is removed from the loaded position on a weight-loading member).

Figure 5:
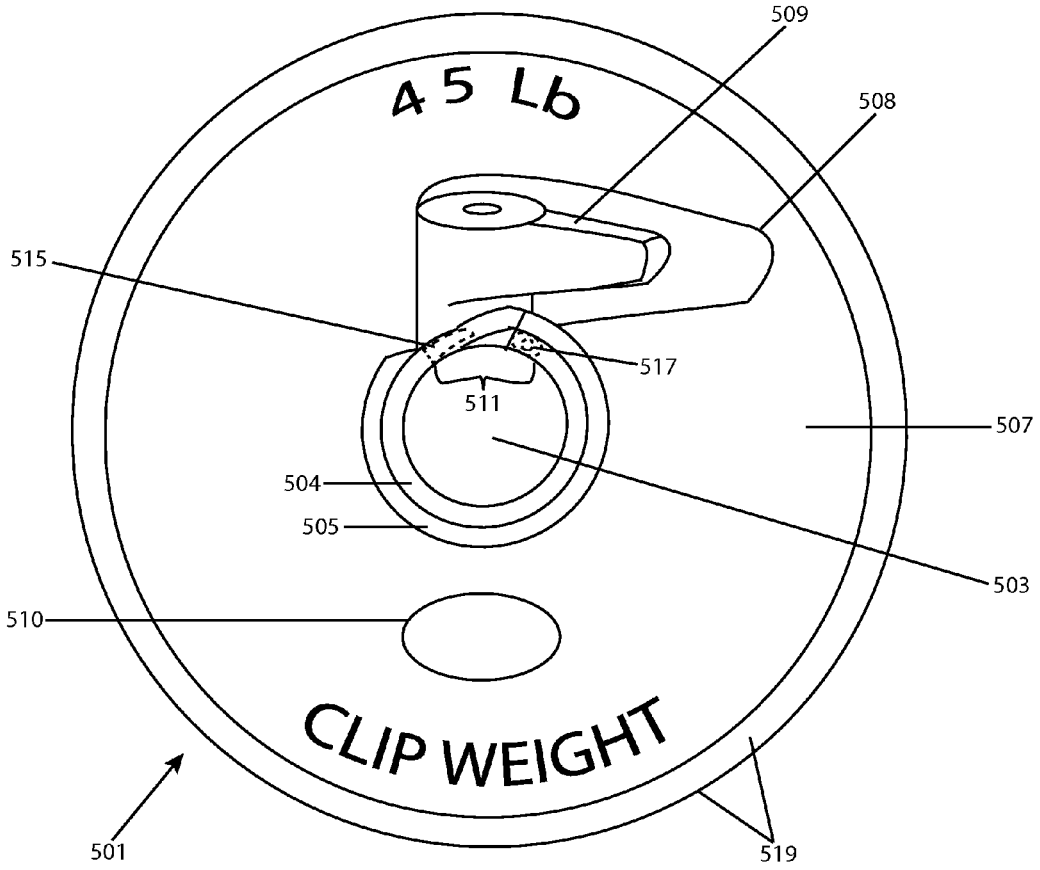
FIG. 5 is a side view illustration of an integrated CLIP-WEIGHT that is directly lockable and unlockable by a user, in accordance with aspects of the present invention.

FIG. 5 is a side view illustration of an integrated CLIP-WEIGHT 501 that is directly lockable and unlockable by a user, in accordance with aspects of the present invention. Central aperture 503 is defined by concentrically-wrapped, self-subducting, tightenable ring layers 504 and 505 mounted on the main body 507 of the CLIP-WEIGHT. Tightenable ring layers 504 and 505 may be tightened by use of lever 509, by rotating it until it is flush against main body 507, in a recess shown as 508. To counter-balance the weight of lever 509 and other clipping aspects about a fulcrum at the center of aperture 503, a matching counterweight 510 may also be attached to the housing, preferably 180 degrees from the center of the mass of such clipping aspects. Internal lever-actuated tightening mechanism 511 (including a pin 515 that may expand with lever rotation and a pin receiving channel that may narrow as a pin enters) may translate rotation of the lever to a perpendicular position relative to the surface of the body 507 of the CLIP-WEIGHT to a maximum loosened position, in which the aperture 503 is at its greatest open width, and a position of lever 509 substantially parallel with and against body 507, by contrast, results in a maximum tightness. Thus, by adjusting lever 509 to the open position, perpendicular to the plane of the surface of the plate, and enlarging aperture 503 to its widest position, CLIP-WEIGHT 501 may be loaded onto a weight-loading member (not pictured) by threading such a member through aperture 503, and the CLIP-WEIGHT may then be secured in place by rotating lever 509 to a flush position with the housing (preferably, aided by a mechanical bias toward the locked position that onsets when the lever is near seating in that position (e.g., by a subfeature notch or valley in the contours of a curved pin 515, or its tightening entry tunnel and housing 517, which pin generally widens as it is rotated into the securing position, flush against the plane of the housing 507, but may deviate to some degree from that progression to create such a notch)). Alternatively, any other locking mechanism may be used to maintain a tightened condition for the CLIP-WEIGHT. As another example, a tension balance point may be used where, tipping beyond the point of balance, the lever is held against the housing in a tightened position. After finishing a workout, to release the CLIP-WEIGHT from a weight loading member (such as, but not limited to, a loading end of a barbell), a user may simply return lever 509 to the perpendicular, loosened position, and the user will then be free to slidably remove CLIP-WEIGHT 501 from said member, for example, by gripping and pulling away the CLIP-WEIGHT by its main housing 507, or enlarged edge 519 away from its loaded position and off of said member.

Figure 12:
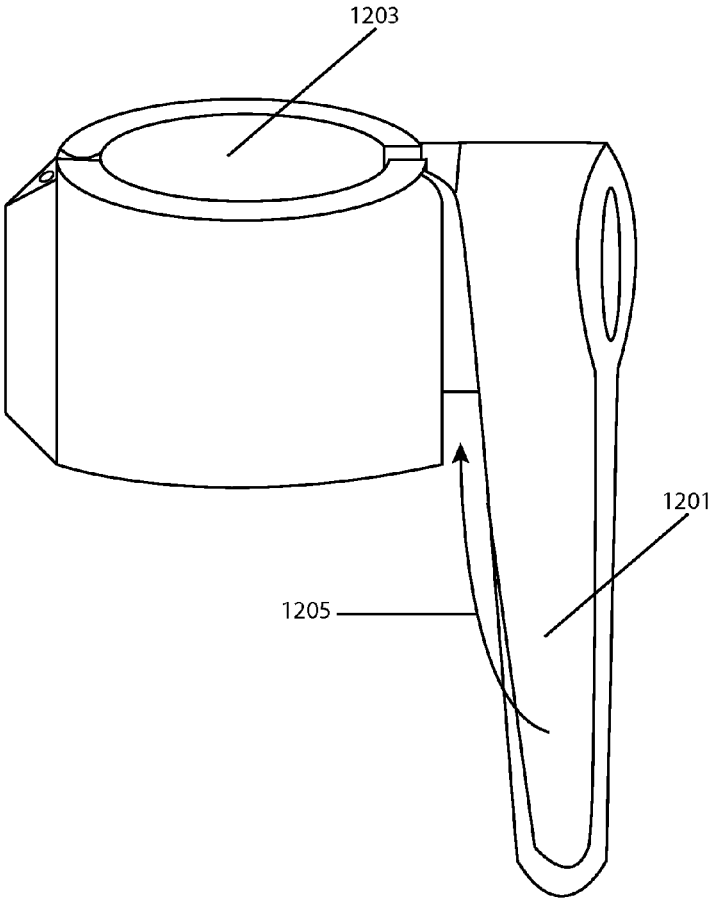
FIG. 12 illustrates another plate-securing collar, according to related art.

Although a new lever-actuated concentric ring subducting and tightening mechanism is shown, it should be understood that any known lever-actuated tightening mechanism, such as the two-part single ring tightening mechanism discussed with reference to FIG. 12, may, alternatively, be used. In such instances, attachment points between the clip aspects and the remainder of the CLIP-WEIGHT are preferably to the axel of the hinge and to part of the lever that does not change its relative position on the CLIP-WEIGHT with lever rotation. As a result, the CLIP-WEIGHT will less substantially stress or strain those attachment points during tightening in comparison to other attachment point design choices. As another benefit, the lever may be rotated in either direction, until it is flush with remainder of the housing of the CLIP-WEIGHT, rather than in just one direction, but such versatility is also possible in some embodiments with concentric ring tightening, where more than one tightening member and/or receiver set is used in the tightening mechanism—and other advantages may be found with concentric ring tightening, including, but not limited to, reduced tightening drag and pinch hazards.

Figure 6:
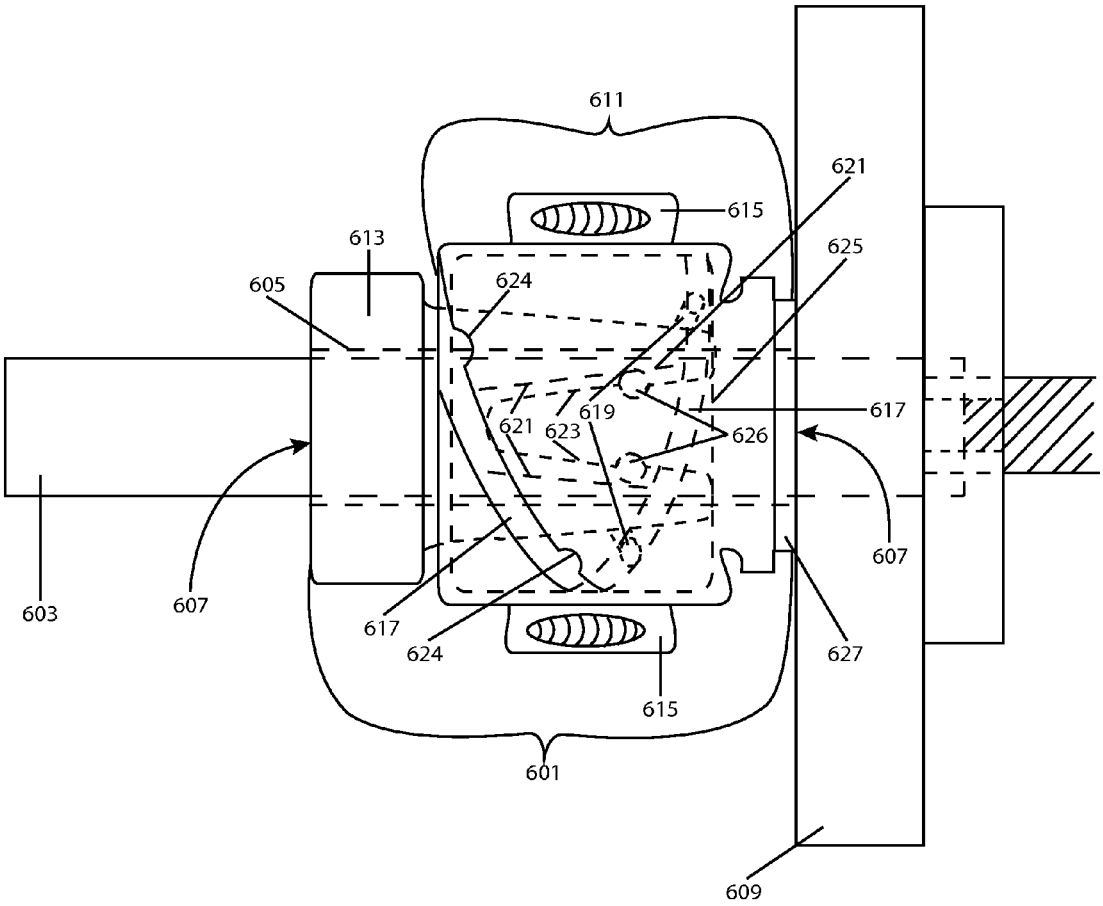
FIG. 6 is a side view illustration of an external clip for securing weight(s) to a barbell, which provides lateral as well as inward tightening force, in accordance with aspects of the present invention.

FIG. 6 is a side view illustration of an external clip 601 for securing weight(s) to a weight-loading member, and for providing lateral as well as inward tightening force, in accordance with aspects of the present invention. In this figure, both the clip 601 and a weight-loading member (such as one loading end of a barbell, 603) onto which it is mounted, among other things, are pictured. Clip 601 comprises a roughly cylindrical (though other shapes may be used) cavity 605, which opens to the outside of the clip at loading apertures 607. In the figure, the barbell end 603 has been threaded through the apertures 607 and cavity 605, by sliding the clip onto the bar left-to-right, from the perspective of the figure, until it abutted plate-style weight 609 which was threaded and mounted onto the end of the barbell 603 prior to mounting the clip 601. In the initial, loaded position shown in the figure, clip 601 rests on weight-loading member 603, without applying substantial securing pressure onto the bar, except for that due to its own gravity, because cavity 605 has a substantially larger, albeit interfaceably-shaped, volume than the volume of the part of weight-loading member 603 surrounded by cavity 605.

Clip 601 is comprised of two main, overlapping sections—twisting, laterally-securing hand-hold section 611 and squeezing securing section 613. After sliding the clip 601 into place, as pictured, against the weight to be secured, the user may tighten aspects of section 613 against the barbell by twisting section 611 using finger-actuated tabs 615, which connect to the housing of section 611. As section 611 twists in a clockwise direction (facing the plate weight 609 it abuts), threads 617 engage with projections 619 on wedging pincers 623, which are a part of/mounted on section 613. This causes the application of at least two relevant forces for securing the clip 601 and weight 609 to the barbell. First, by pushing section 611 toward the plate weight 609, section 611 applies lateral securing force to weight 609, which increases until projections 619 each reach a locking pocket 624 on threads 617, which corresponds with an appropriate amount of lateral force exerted for securing the plate weight 609 within mechanical tolerances of the clip 601 and its materials. Second, sloped inner contours 621 of an encompassing cavity 625 within section 611, which surrounds pincers 623, then cause wedging pincers 623 to pinch inwards, because contours 621 slidably engage with projections 626, attached to the outside of pincers 623—creating inward gripping force onto weight-bearing member 603 (the barbell). Various other shapes, numbers of attached interfacing and other mechanical force exerting mechanisms may, alternatively, be used, in addition to or in lieu of the exact embodiments pictured and within the scope of the invention. For example, in some embodiments, a single set of thread-interfacing projections, such as projections 619, may be used to both interface with lateral-force-applying threading and to cause the inward tightening of a tightening section of the clip. For example, this simultaneous tightening and thread engagement may be accomplished by an inward (toward the center of the barbell) narrowing of the threading. Elastomeric section 627 provides cushioning for plate weight 609 and section 613, and also assists in creating even application of applied lateral force. To release clip 601, the user simply twists section 611 in the counterclockwise direction, and may then slidably remove clip 601 from end of the weight-bearing member 603 and barbell.

Figure 7:
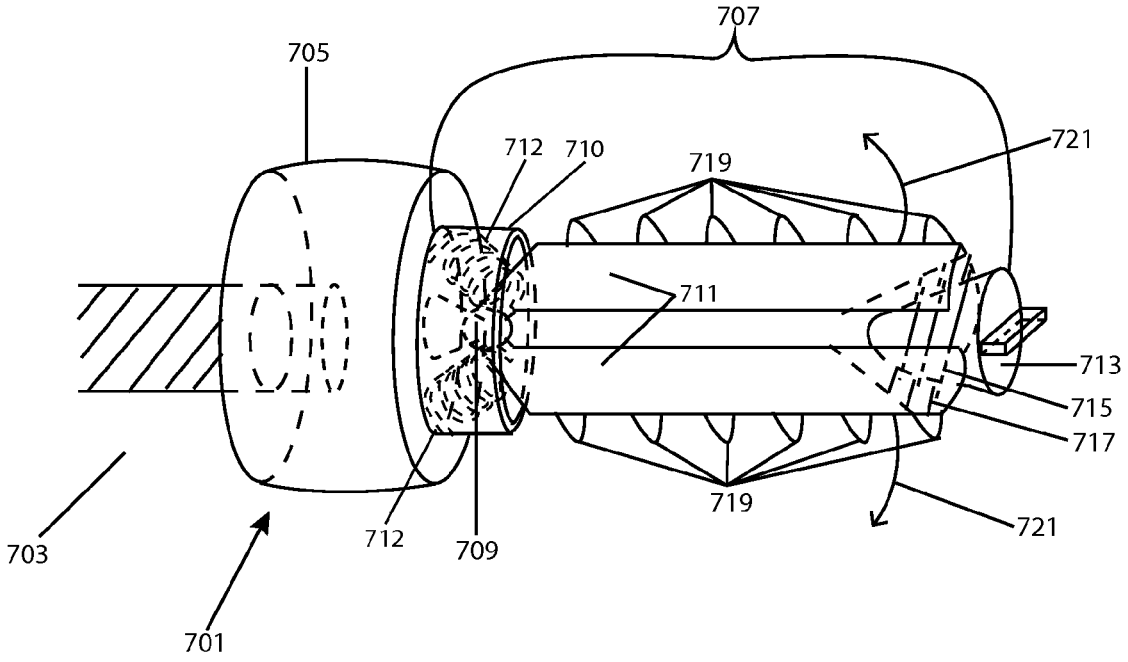
FIG. 7 is a side view illustrating an integrated barbell/clip system, for securing weights to a barbell, in accordance with aspects of the present invention.

FIG. 7 is a perspective view illustrating an integrated barbell/clip system 701, for securing weights to a barbell, in accordance with aspects of the present invention. Although the specific configuration of the end of a barbell is shown, it should be understood that a variety of other weight-loading members, of a variety of other shapes, may also implement aspects of the invention discussed with reference to the figure. Beginning at the left-hand side of the figure, part of a cylindrical barbell handle 703 is shown, which a user may use to lift, move and otherwise use the barbell. Barbell handle 703 is connected to cylindrical support lip 705, which is wider than both the handle 703 and a barbell securing and mounting complex 707, abutting lip 705, and also connected to it, on the other (right-hand) side. Lip 705 serves as a wall for securing a weight (not pictured) that may be mounted onto barbell securing and mounting complex 707 by threading such a weight's loading aperture onto it and, thereby, also loading such a weight onto the entire barbell/clip system 701. Barbell securing and mounting complex 707 is connected to lip 705 and, therefore, the remainder of the barbell, via cuffed hinge 709. Rotatable, semi-cylindrical mounting slats 711 within complex 707 are each rotatably connected to and form part of hinge 709 (which is preferably force-biased to rotate the slats inward, toward one another, for example, by a spring set 712), such that they may be moved in the direction shown by motion arrows 721, against that force-biasing until reaching a physical limit where their outer surfaces collide with the right-hand circular edge of the cuff 710 of cuffed hinge 709. Internal, interfacing gears (not pictured) may cause the degree of rotation of each of slats 711 with hinge 709 to mirror one another and remain constant about the central axis of the barbell/handle 703 (and with respect to support lip 705). An inserted, handled spreading member 713, with male threading 715, may aid in creating (or reversing) the potential rotating motion shown by arrows 721 by spreading slats 711 apart (when screwing member 713 inward, clockwise, toward the handle 703) or allowing spring set 712 to rotate them together (when unscrewing, outward). Spreading member 713 is threaded onto the right-hand-side ends of mounting slats 711, which form a cavity with complementary female threading to accept the male threading spreading member 713. Due to the shape of 713 (and/or the cavity), which enlarges the gap into which it is threaded as it is threaded in, a user may spread mounting slats 711 apart after placing an aperture or other mounting feature of a weight over them, creating outward pressure that secures the weight to the barbell, by rotating spreading member clockwise (assessed viewing toward the barbell handle 703), and vice versa, for unmounting a weight, for example, after completing an exercise. Gripping ridges 719 may aid in securing the outside edges of a loading aperture or other mounting features of a loaded (e.g., plate-style) weight. Preferably, gripping ridges 719 include faces that are angled such that a variety of possible rotation positions of slats 711 will result in optimal securing force. For example, the rotation angles of slats 711 resulting from a standard-aperture plate style weight being mounted at the position where its outer edge abuts a given ridge 719 may define the optimal angles of that gripping ridge at that position, for example, such that the resulting angle at that position leads to a substantially perpendicular (edge-opposing) interface, or even a barbed interface, with the edge of the weight.

Figure 8:
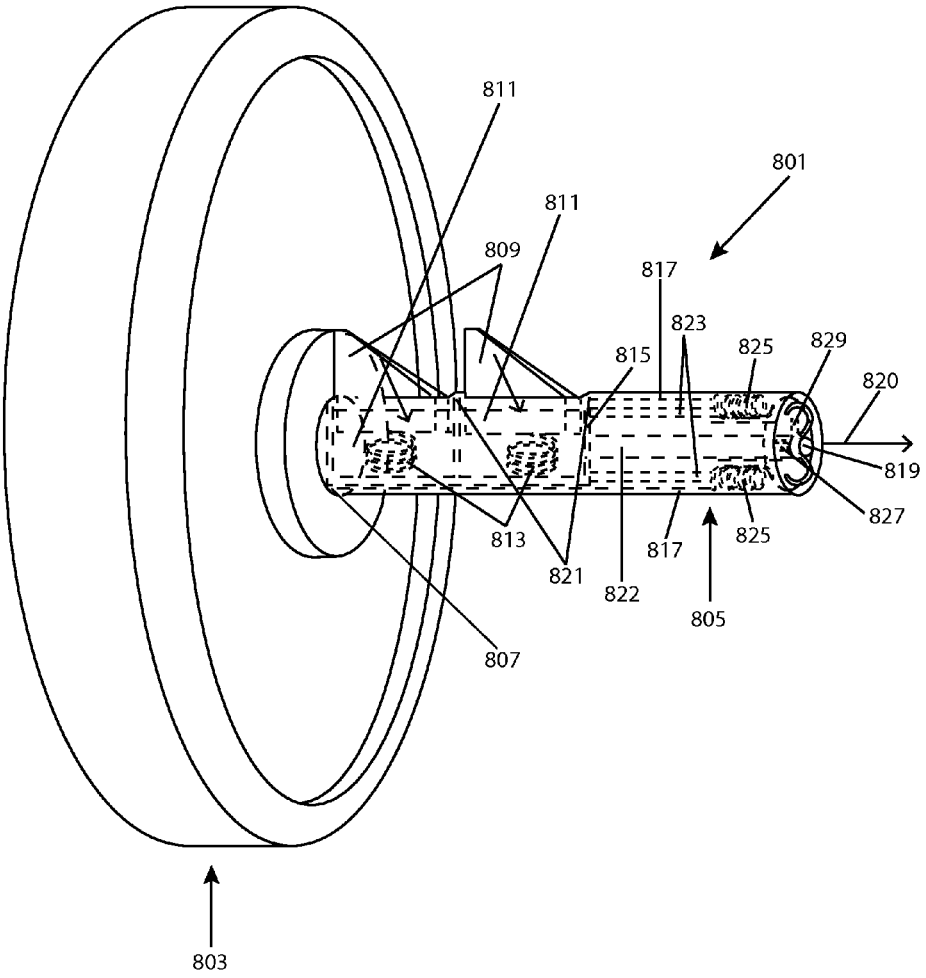
FIG. 8 is a perspective view illustrating another integrated barbell/clip system, for securing weights to a barbell, in accordance with aspects of the present invention.
Figure 9:
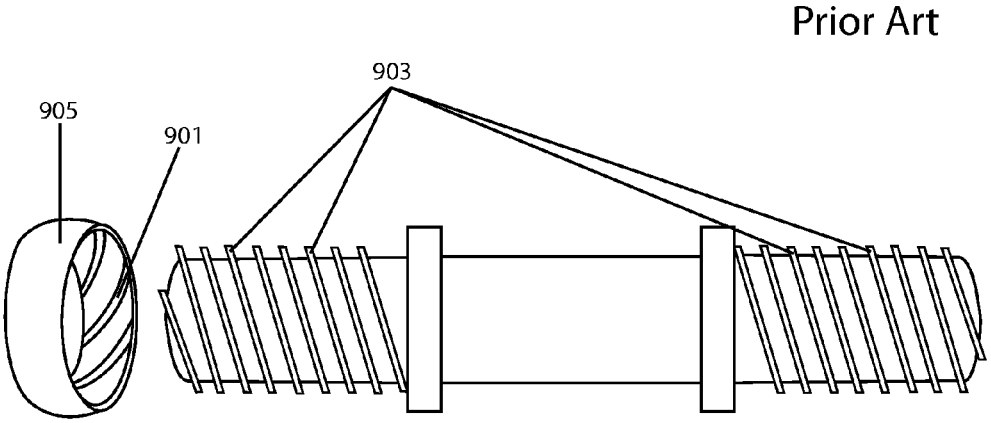
FIG. 9 illustrates a plate-securing collar, according to related art.
Figure 10:
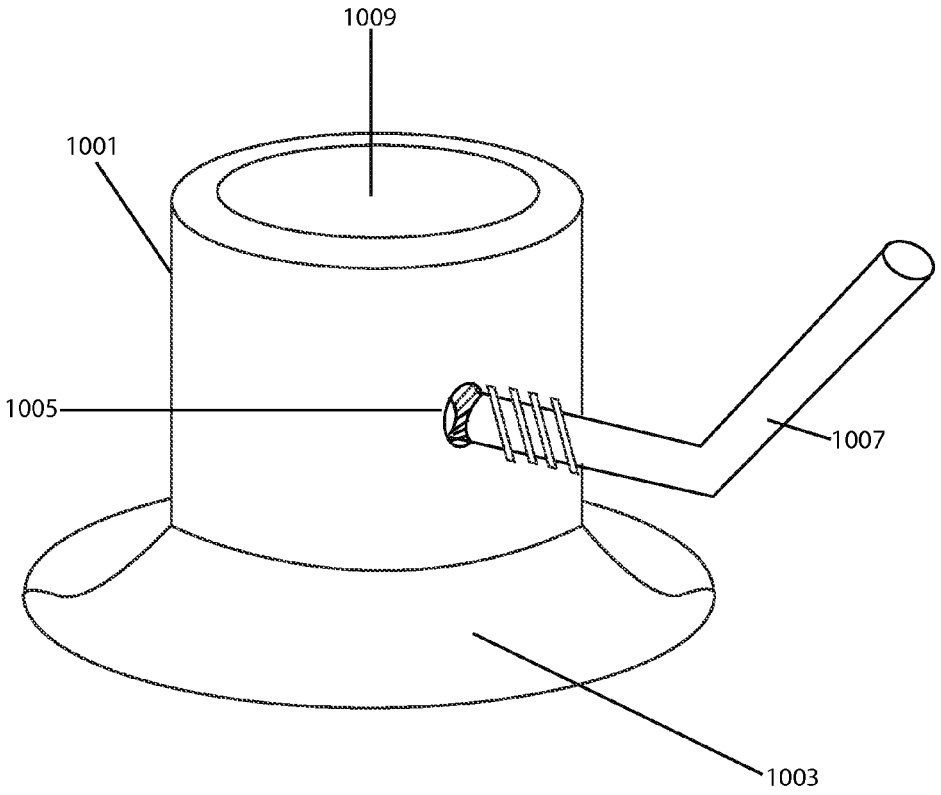
FIG. 10 illustrates another plate-securing collar, according to related art.
Figure 11:
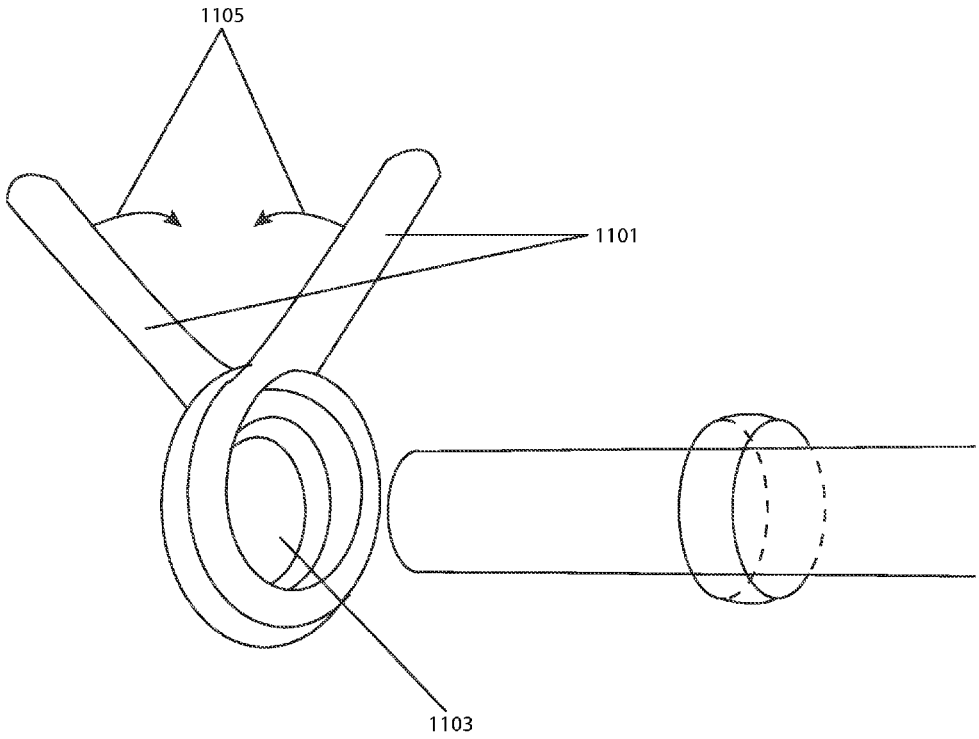
FIG. 11 illustrates another plate-securing collar, according to related art.

FIG. 8 is a perspective view illustrating working parts of another integrated barbell/clip system 801, shown securing a plate-style weight 803 to a barbell, which the system may comprise, in accordance with aspects of the present invention. In the figure, the mounting end of the barbell 805 has been threaded through the aperture 807 of weight 803, by sliding it from right to left, until reaching a handle-terminating support or collar (not pictured) to the left-hand side, and part of and attached to the barbell. At this point, the weight is on a mounted position on the barbell. Depressible securing members 809 responded to the aperture being threaded over them by yielding downward, due to their ramped shape, into member-accepting pockets 811, until they were in far enough that they no longer obstructed the plate aperture 807, which then passed to the left of them. At that point, securing members 809 rose, due to force, e.g., from a stored force/bias mechanism(s) such as springs 813, to their original position (pictured) with respect to the remainder of the barbell. In that position, the weight 803 is secured from slipping toward and off of the end of the barbell 805 by the flat, left-hand side of members 809. The members 809, force bias mechanism(s) 813, and pockets 811 are contained, as a group, by a containing housing 815, which, itself is slidably housed in an outer housing 817. By using grip/handle 819, a user may slide housing 815 within outer housing 817 toward the mounting end of the barbell 805 as shown by motion arrow 820, with the aid of a pull-rod 822 connecting the handle 819 and the inner housing 815. In so sliding, inner housing 815 drags members 809 toward ceiling bars 821 of the outer housing 817, engaging with the ramped sides of the members 809, and depressing them into pockets 811, until they are fully depressed into the pockets as inner housing 815 drives attached spring compression rods 823 against springs 825. Force biasing, such as springs 825, oppose the handle pull and further compress in response to it such that, if handle 819 is no longer held and pulled, inner housing 815 is forced back to its previous position (pictured) and members 809 return to their ejected, securing position (as also pictured). In that position, handle 819 may be rotated to lock the inner housing in its securing position, with members 809 ejected, for example, by use of an axel-mounted inner tab 827, which is interior to the outer housing 817, and which is so rotated until it may no longer escape through a notch 829, in the housing. Preferably, an indicator (not pictured) may indicate to a user whether the bar is so locked, and, therefore, safe to use due to the weight-securing system 801. Such an indicator may be in addition to and/or keyed to proper handle rotation for locking and releasing the system's weight-securing properties. For example, a tab connected to a rotatingly-revealed colored indicator (not pictured) may collide with the tab inside the housing 817 at a safe rotational position and may further provide a stop for that rotation, preventing the inadvertent release of the tab 827.

Alternatively, a lock that is applied by release of a release handle, such as handle 819, may secure the inner housing 815 in place, thereby securing any weight in place without the need to separately lock the handle. The number, size and spacing of securing members, such as those shown as 809, may be in a wide variety to match the loading positions of any combination of loaded weights. Further, the tabs, or outer housing, may be laterally loaded to provide lateral securing force against loaded weights. In one embodiment, members 809 do not emerge until the user pulls one or both of the housings toward the end of the barbell, pulling the members against that lateral force loading, and beyond the distal edge of the loaded weight(s)—thereby creating and applying that lateral force, and removing any obstacle to threading the weights. A second pulling of one or both of the housings (again, e.g., by a handle pull) may then retract and lock members 809, permitting removal of the weights after exercise.

A mechanism that resists force against the inner housing 815 originating from one side in the sliding path only (the mounted weight side of the handle 819), such as a ratchet, may also, alternatively, be used, to eliminate the step of a user needing to twist or otherwise separately unlock the handle and the inner housing, because pulling force from the handle, and not pushing force from the weight, will permit moving the inner housing 815 within the outer housing 817. As another alternative, handle 819 itself may be rotatably biased toward the locking position, and a user may be required to twist and pull it to move inner housing 815 within 817, but need not actively lock handle 819.

FIGS. 9-12 illustrate some aspects of the related art, and are discussed in greater detail above, in the background section of this application.

Figure 13:
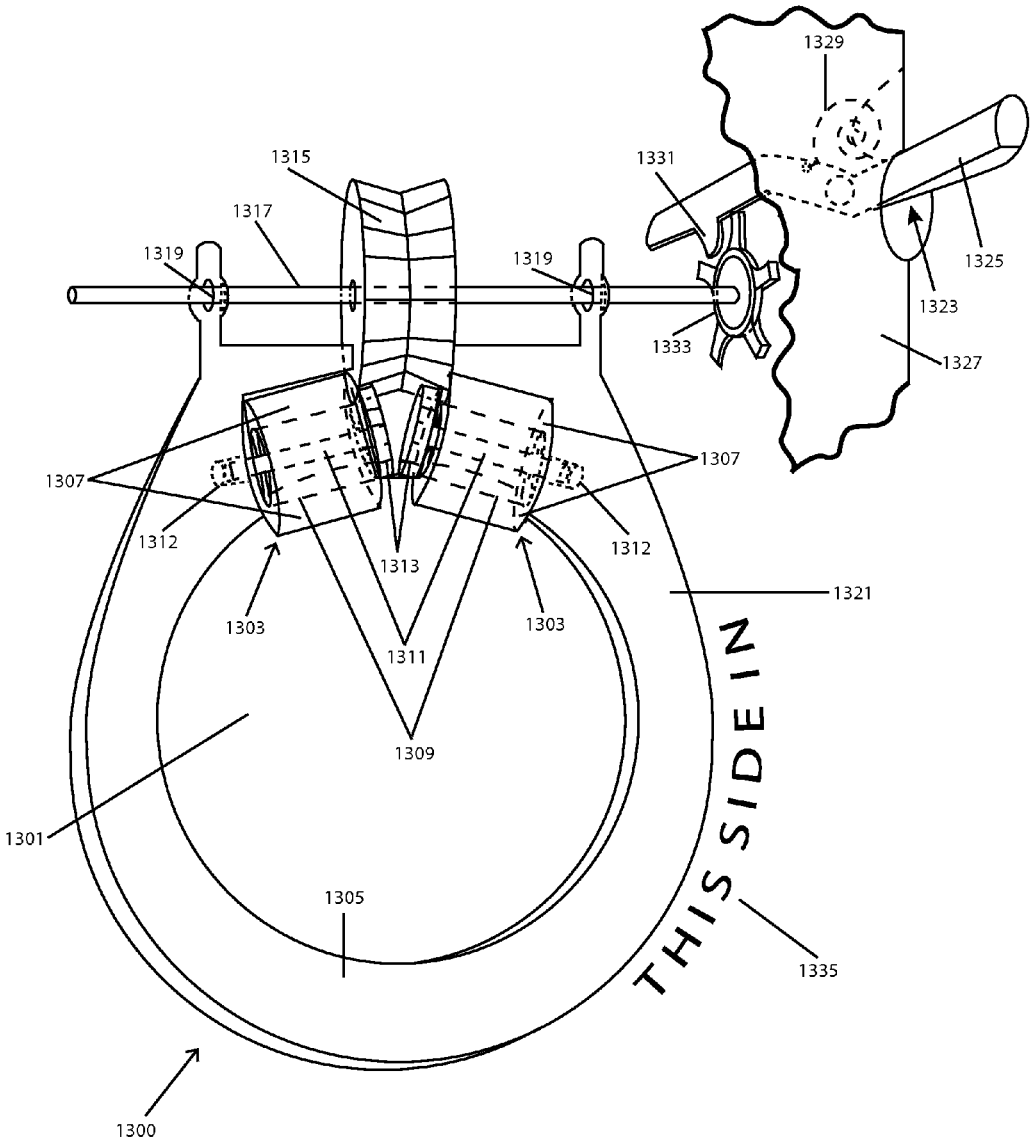
FIG. 13 illustrates a new integrated CLIP-WEIGHT that, when put into position on a weight-loading member, locks into place securing itself in one direction, and is removable by a user-actuated release.

FIG. 13 illustrates part of the loading mechanism of a new integrated clip or CLIP-WEIGHT 1300 that, when put into position on a weight-loading member, locks into place, securing itself against sliding in one direction, and that is removable by a user-actuated release. A loading member, such as the loading end of a barbell (not pictured) may be threaded through loading aperture 1301 to begin loading the clip or CLIP-WEIGHT 1300 for use. Preferably, the barbell is threaded such that the CLIP-WEIGHT is oriented upright, as shown in the orientation of the figure, and an oblong and/or channeled shaping of the aperture 1301 or otherwise gravity-forcing aspect of the CLIP-WEIGHT may be added to ensure such orientation in loading, but CLIP-WEIGHT 1300 may be placed in other rotational positions on a threaded member and still accomplish aspects of the present invention. Also preferably, the weight-loading member, such as the end of a barbell, is of a width and shape that creates pressure between it and one-way locking, one-way rolling and/or ratcheting cylindrical wheels 1303. Such pressure may be created by a number of structural aspects, including inner aperture wall 1305 which, together with wheels 1303, creates inward, vice pressure on the weight-loading member—due, for example, to a width of a loaded structural member complementary to aperture 1301, but which wheels 1303 invade. Aiding in creating this pressure and locking grip, while preventing mechanical failure, are elastomeric outer wheel sections or tires 1307, which substantially surround, as a whole or at periodic points or areas, rims 1309 and rotational axels 1311. Preferably, rims 1309 are at least temporarily fixed to tires 1307 and also rotate about axes 1311 which, themselves, may spin within housing cavities 1312 within structural frame 1321. Fixed to each of rims 1309 and/or tires 1307 is one of gears 1313, each of which also rotates about one of the axes of axels 1311, and interface with ratcheting master gear 1315. Master gear 1315 itself rotates about a common axis with, and is fixed to, its own axel 1317, and is fixed in distance to aperture 1301 and wheels 1303 with the aid of axel mounts 1319 on frame 1321—such that gear 1315 remains properly interfaced with each of gears 1313 to provide one-way rotation locking ("ratcheting") which may be released by user actuation of additional mechanisms discussed in greater detail below.

Providing releasable one-way rotational locking (ratcheting) is sprung (or otherwise force-biased) lever 1323, which preferably comprises a handle 1325 that is at least partially user-accessible through an outer CLIP-WEIGHT housing, partially pictured as 1327. Also preferably, force-biasing, such as that provided by spring 1329, places lever 1325 in a position that causes one-way rotationally locking tab 1331 to interface with a rotating gear 1333 which rotates about a common axis with, and is rotationally fixed to, axel 1317. As a result, when a user has not actuated release lever 1325, gear 1333 may spin counterclockwise only, from the perspective shown in the figure, and force toward clockwise rotation would result in locking of tab 1331 against the teeth of gear 1333, because the side of the tab facing the approaching teeth in that rotation is flat (as are the faces of the teeth facing the tab), and does not allow the teeth to push out the lever during rotation. However, when rotating in the opposite direction (counter-clockwise), the side of the tab facing the face of the approaching teeth during rotation is rounded (as are the faces of the teeth facing the tab), permitting unlimited rotation. And, as a final result, a weight-loading member, such as the end of a barbell, should be threaded through aperture 1301 into the page, from the perspective of the figure, allowing it to be loaded and locked into place, as may be advised to the user via markings 1335. The exact mechanism shown in this figure for providing one-way rotational locking of gripping wheels is exemplary only, and any other method and mechanism known in the art may be substituted, although such mechanisms have some disadvantages in comparison to the mechanisms and techniques illustrated with reference to the figure.

It may be preferred, in some aspects of the invention, for a ratcheting selection mechanism to be added to the ratcheting mechanism of FIG. 13, such that initial loading-caused pressure (e.g., rotational pressure and/or directional pressure against wheels 1303 or aperture wall(s) 1305) results in selection of a direction of ratcheting complementary to the direction of threading the weight bearing member onto aperture 1301. For example, gears 1313 may instead be initially, after release by lever 1325, unengaged with master gear 1315, and the pressure of initial mounting while freely rotating the wheels may be used to indicate the preferred direction of free, ratcheting movement, and push and/or turn a locking direction selection mechanism enabling ratcheting in that direction only, prior to further pressure engaging gears 1313 and 1315 and so selecting the correct direction of rotation of gear 1333 to permit the correct direction of ratcheting. For example, the proper direction of rotation of gear 1333 may be accomplished by a gear selector and additional gears for reversing the rotation of gear 1333, as necessary, in response to directional and rotational pressures translated to actuate the gear selector. In some embodiments, the spinning of gears 1313, or new gears on the opposite side of wheels 1303, could be used to drive a rotational ratchet direction selection mechanism, as may be found on most conventional ratcheting socket wrenches, but such gears could automatically slip after such selection, for example, by a maximum torque setting that, after being reached, permits slippage, or a simple push-switch that then allows the gear to slide past.

Figure 14:
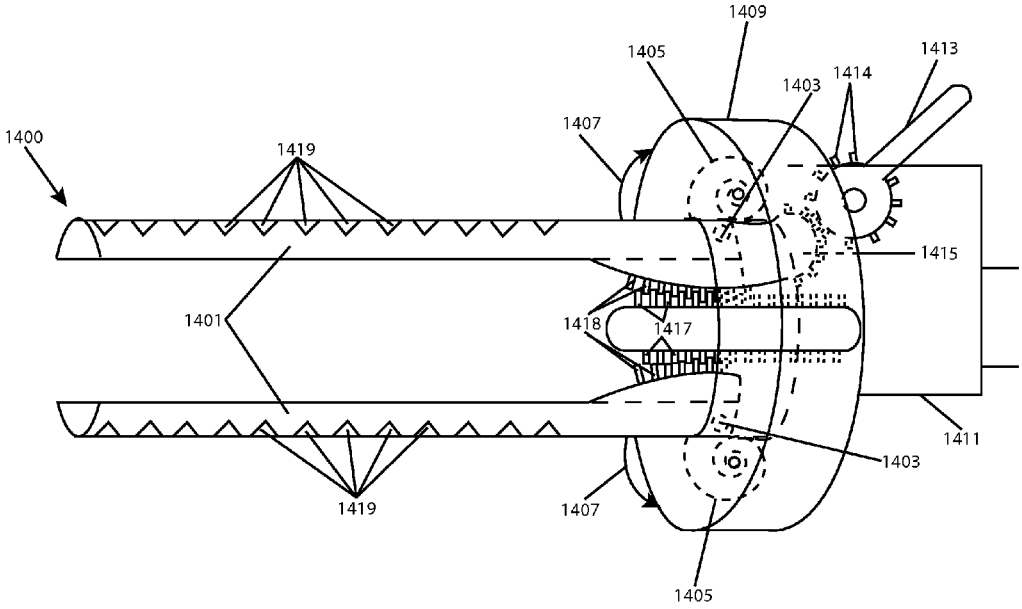
FIG. 14 provides a perspective view of certain barbell aspects of a barbell and weight securing system, which, among other things, allows the selective rapid release of loaded weights.
Figure 15:
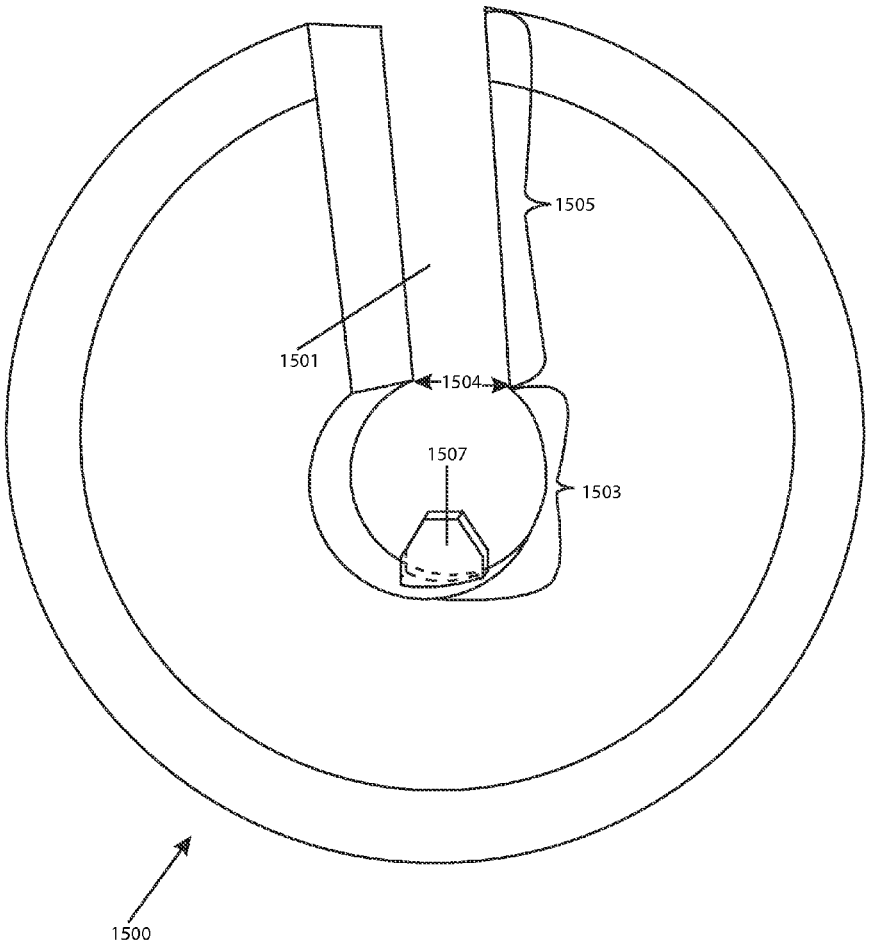
FIG. 15 provides a perspective view of certain weight and weight-securing aspects of the barbell and weight securing system subject to FIG. 14.

FIGS. 14 and 15 provide a perspective view illustrating a barbell and weight securing system, which enables a user to load several weights securely onto a barbell, and then rapidly and selectively drop weights mid-bar, without the need to thread or unthread a weight onto the barbell, in accordance with aspects of the present invention. FIG. 14 provides a perspective view of certain barbell aspects of the barbell and weight securing system, while FIG. 15 provides a perspective view of certain weight aspects of the barbell and weight securing system, including, but not limited to, mounting aspects.

Beginning with FIG. 14, the specialized weight-securing end 1400 of a barbell, implementing some aspects of the system, is illustrated in a perspective view. Two semi-cylindrical weight-threading and -securing leaves 1401 are rotatably-mounted at hinges 1403, and are force-biased, for example, by springs 1405 that apply rotating pressure in the directions shown by force arrows 1407, which depict the directions of torque applied by force biasing 1405. An outer limit for rotation due to the force-biasing may be provided by weight stopping wall 1409 at the edge of, and attached to, the gripping section 1411, of the barbell. Although leaves 1401 are shown in rotated positions parallel to one another, stopping wall 1409 preferably arrests rotation of the leaves at a wider position for leaves 1401 and/or their gearing relative to one another, and a user may compress them by hand or by using actuating lever 1413, which itself is rotatably mounted on barbell grip 1411, and comprises gear teeth such as those shown as 1414 and interfaces with gearing 1415 to drive both leaves 1401 (rotating them inward, compressing them toward one another, if the lever is actuated, pushed toward the bar). Additional gearing, such as that shown with gear teeth 1417 and 1418, may be driven by 1414 and 1415 and/or force-biasing 1405, and may both drive and sync the rotations of each leaf 1401. A wide variety of alternate forms of gearing, teeth or other mechanical driving connections, and driving and selecting pieces (including, for example, electromechanical devices, buttons or switches rather than levers, mounted in any accessible place for a user) may be used to accomplish the objectives of the invention; the exact mechanical force actuation and translation shown in FIG. 14 is exemplary, and preferred, but not exhaustive.

Although two semi-cylindrical weight-threading and -securing leaves are illustrated in FIG. 14, virtually any number of additional leaves may also be included or substituted, which may have a number of differing shapes, including, but not limited to, having hollowed centers and/or greater surface area or rectangular shaping or irregular, periodic shapes that aid in securing weights. For example, three such leaves, or one such leaf in conjunction with a fixed leaf, may alternatively be used.

Upon loading a weight into a loading position on the barbell end 1400, preferably using an aperture/notch in the weight designed for facilitating mounting, leaves 1401 are pressed into the edges of such an aperture/notch in the weight, due to force-biasing means 1405, mounted to both leaves 1401 and wall 1409. As this occurs, the leaves separate from one another (scissoring outward). To increase their securing power on the weight, leaves 1401 preferably include gripping notches, such as the examples depicted as 1419, along the weight-interfacing, outward surface of the leaves, which serve to catch edges of the aperture or notch of any secured weights. Preferably, gripping notches 1419 have angled edges that, based on a standard weight aperture/notch width, match or are optimally barbed toward the flat surface of the interfacing edge of the weight aperture/notch at each possible gripping notch/outer edge location of such an aperture/notch of a mounted weight position.

Although gripping notches 1419 are pictured, a number of alternative weight-securing surface features and/or surface types and/or coatings that aid in securing weights placed onto leaves 1401 may, alternatively, or in addition, be used, including, but not limited to, elastomeric outer layer(s).

While the barbell aspects of the system for securing weights discussed with respect to FIG. 14 may be used in conjunction with standard or other existing plate-style and other weights, preferably, a specialized form of weight with rapid and selective weight dropping notches and leaf-width limiters is used, which prevent dropping other-than-selected weights for unmounting, as will be explained in greater detail with reference to FIG. 15.

FIG. 15 is a perspective view illustration of certain weight aspects of the barbell and weight securing system discussed with respect to FIG. 14. A weight 1500 includes an aperture/notch 1501, which includes two separately-sized and/or -shaped cavities: securing cavity 1503 and loading/unloading cavity 1505. Loading/unloading cavity 1505 is pictured as narrower, than the diameter of securing cavity 1503, as demonstrated by constricted entry width 1504, such that a weight-loading member, for example, the end of a barbell (not pictured in this figure), of a certain width would secure weight 1500 even if loading/unloading cavity 1505 were placed directly above it, and gravity were forcing the member toward cavity 1505. As a result, by varying the width of a weight loading member, for example, using the rotatably-mounted leaf expanding and contracting system discussed with reference to FIG. 14, a weight may be (1) secured in place (if the leaves are expanded to push against the walls of cavity 1503 wide enough to prevent entering cavity 1505) or (2) dropped (if the leaves are contracted, such that they may pass into cavity 1505 and exit the notch aperture 1501 due to gravity).

In order to selectively drop just one weight from the edge of a group of loaded weights on the bar of FIG. 14, a leaf contraction-limiting tab 1507 may be included in a preferred embodiment. When the weight 1500 is properly mounted onto the end of the barbell featured in FIG. 14, tab 1507 may fit in between leaves 1401 and, based on the size of the leaves and possible gaps between the leaves 1401 and the aperture/notch 1501 and between the leaves and tab 1507 while the end of the barbell is threaded through the weight, contracting the leaves results in sufficient contraction to allow the weight to escape, but a neighboring weight(s) with the same mounting aperture/notch structure will not be able to escape because the leaves are held at a greater width than its loading/unloading cavity width, due to notch 1507 holding the leaves wide enough at a neighboring location (but not at the location of the loaded weight 1500) to prevent escape at that neighboring location, owing to the differing width of the leaves at neighboring locations due to the v-shaped scissoring action of the leaves 1401. Whether a neighboring weight to the outside or inside of the weight on the bar with a notch arresting contraction will so drop by gravity depends on the exact relative sizes of the aperture/notch 1501 and the leaves, and whether that notch width and/or securing cavity width forces the leaves into a contracted position (with rotation angles more acute than parallel) or an expanded position (rotation angles widening as judged from the handle to the loading end of the loading section of the bar) when the weights are all loaded and secured due to expanding pressure from force loading 1405. In the latter instance, the inner-most (mounted toward the barbell handle) loaded weight will drop upon one lever pull action, and no further weights will drop (due to the arresting action of a tab 1507 of the neighboring weight). In the former instance, the outer-most weight only will drop upon one lever pull.

Figure 16:
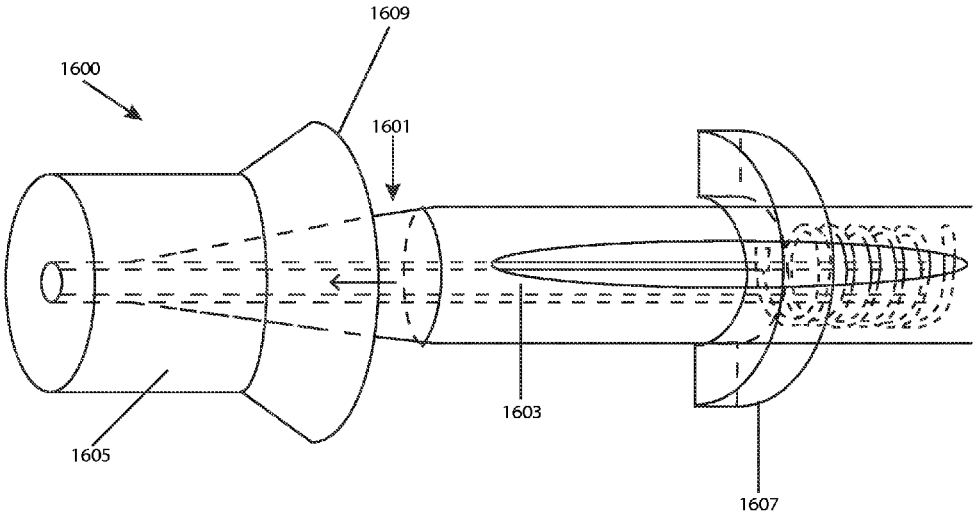
FIG. 16 is a perspective view illustrating another integrated barbell/clip system, for securing weights to a barbell with active lateral force support, and which also allows the selective rapid release of loaded weights, in accordance with aspects of the present invention.

FIG. 16 is a perspective view illustrating another integrated barbell/clip system, part of which is shown as 1600, for securing weights to a barbell with active lateral force support, and which also allows the selective rapid release of loaded weights, in accordance with aspects of the present invention. A slotted aperture of an aperture-loading weight, such as the slotted aperture of the specialized weight discussed with reference to FIG. 15 (including both a loading and a securing section), may be wide enough to slide onto a weight-mounting member at a selectably narrow section 1601, when selected to be narrow enough for mounting and/or unloading such a weight, as pictured. A pushrod 1603 may extend or retract (by a lever, button or other pushrod driving mechanism, which is not pictured) a sliding size selecting collar 1605, such that the selectably narrow section 1601 may be varied in exposure (i.e., maximum bar width exposed to interfacing with the specialized, notched weight) for mounting/unmounting a weight. Preferably, when actuated, the pushrod driving mechanism temporarily extends pushrod 1603 and selection piece 1605 sufficiently in length and in time to permit one such slotted plate-style weight to fall through the resultantly sufficiently narrow, temporarily exposed section, 1601. But, also preferably, the pushrod driving mechanism and/or user actuating it causes the automatic retraction of the pushrod 1603 and selection piece 1605 after a single such plate-style weight has dropped, preventing further weights from dropping until an additional actuation of the pushrod driving mechanism. A force-loaded, slidable cuff 1607 preferably drives any loaded weights snugly against a flange 1609 on selection piece 1605, and also ensures the unloading of the most distal loaded plate-style weight when the pushrod driving mechanism is actuated, by forcing such a plate style weight into the narrow section 1601. But, when pushrod 1603 is not being actuated, the distal force from cuff 1607 is insufficient to oppose force biasing of collar 1605 and/or the pushrod, which holds section 1601 in a closed, unexposed position, within a central cavity of collar 1605.

Figure 17:
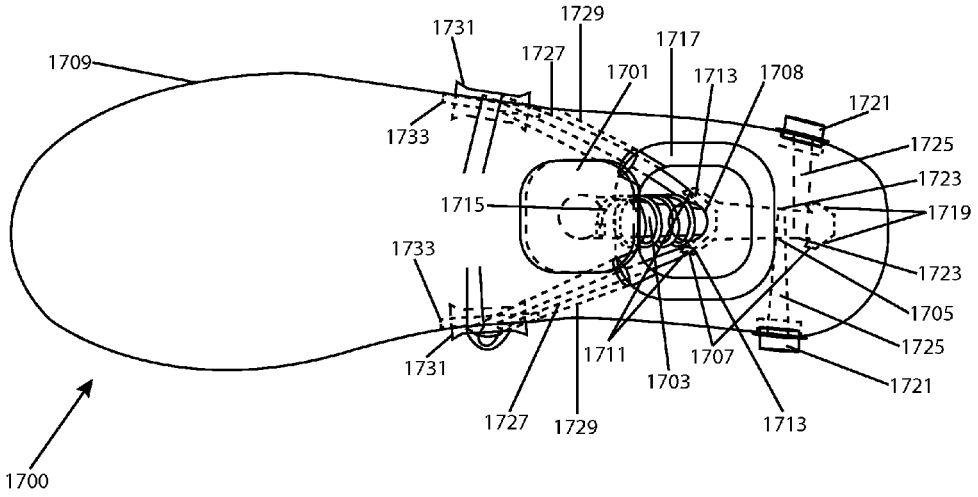
FIG. 17 is a top view of aspects of a member-attaching and securing, weight-actuated clip mechanism, as applied in the context of loading objects onto a biological weight-baring member, specifically, in the context of sporting footwear, in accordance with aspects of the present invention.
Figure 18:
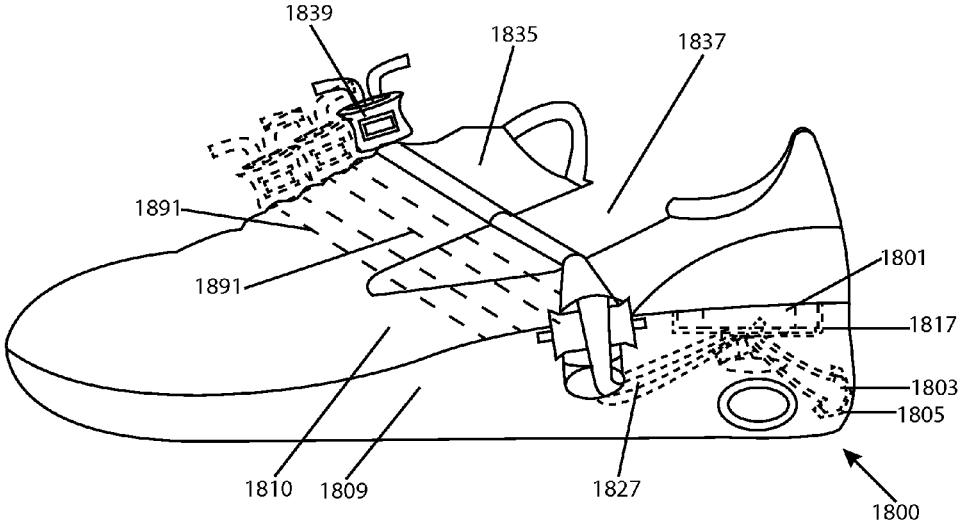
FIG. 18 is a side view of aspects of the same mechanism as that illustrated in FIG. 17.

FIGS. 17 and 18 are a top and side view, respectively, of aspects of a member-attaching and -securing, weight-actuated clip mechanism, 1700 and 1800, as applied to human footwear, in accordance with aspects of the present invention.

Beginning with FIG. 17, a force-loaded user's heel-compressible platform 1701 is mounted on a guiding/locking member 1703, which variably interlocks with or travels within a channel 1705 with barb-accepting pockets, such as those shown as 1707. Member 1703 may partially exit channel 1705 through sole port 1708, which is a foot-facing opening to channel 1705, which itself is cavity within footwear sole 1709. But member 1703 and platform 1701, to which it is attached, are prevented from completely exiting sole port 1708 by barb-interfacing pockets 1711, into which member barbing 1713 collides as member 1703 moves toward exiting channel 1705, toward the left and upwards out of the figure (positive z axis), the direction in which it may be forced by force loading (such as spring 1715, which may be mounted to both the bottom of platform 1701 and the top of sole 1709) and/or by tension from other aspects of the invention, for example, from lacing (which will be discussed below).

When member 1703 is extended substantially out of port 1708, as pictured in FIG. 17, a user may compress platform 1701 substantially downward and toward the top of sole 1709 (and, optionally, and/or depending on the exact shape designed and implemented for channel 1705 and the resulting optimal direction to match the angle of its walls, also toward the rear of the sole), and, in so doing, the user may insert member 1703 deeper into channel 1705. In turn, barbing 1713 may escape pockets 1711 inwardly, due to their one-way motion permitting, complementary ramped sides on leading surfaces as the member 1703 penetrates channel 1705 more deeply. As a user presses platform 1701 downward, he or she may also compress spring 1715 until, if enough downward pressure is provided, the platform 1701 reaches a terminal position, seated and preferably countersunk in complementary depression 1717 on the top surface of sole 1709, and barbing such as 1713 locks with barb-interfacing pockets 1719, at the inward/downward end of channel 1705. Preferably, barbing 1713 is held strongly enough and with sufficient endurance to counteract not only compressed force biasing (such as spring 1715), but also any forces encountered in use of the sporting equipment surrounding or otherwise attached to the mechanism discussed in FIGS. 17 and 18, and also with sufficient strength and endurance to maintain a tightening force, which may be variably chosen by the user or a system, applied to an attached lacing or other force-applying tightening structure, an example of which is discussed in greater detail, below. At a user's option, however, barbing 1713 may be released at any time from barb-interfacing pockets 1719 by pushing barb-releasing, pocket-flattening squeezable buttons 1721. Although a number of other release mechanisms are known in the art and may be used in some variations implementing aspects of the invention, squeezable buttons 1721 are attached to flexible, compressible material or hinge pieces, such as 1723, that variably define variable barb-retaining pockets, such as those shown as 1719, via push rods, such as those shown as 1725. When buttons 1721 are in their resting position (not pressed by a user), barb-interfacing pockets 1719 have a resting conformation as shown by their shapes in FIG. 17. However, when buttons 1721 are pressed by a user, pushrods 1725 compress compressible material/hinge pieces 1723 such that the barb-holding walls of barb-interfacing pockets 1719 are eliminated, laid flat or otherwise sufficiently reduced to allow barbing 1713 to escape upwardly from pockets 1719, and for member 1703, in turn, to rise again from channel 1705, and release tension from attached tension or compression-creating structures, such as lacing 1727, which may be attached anywhere to the length of member 1703 along the surface of channel 1705, and preferably, in its own lacing guides or channels, such at that shown as 1729. Lacing 1727 may also be guided around corners or other friction-creating surfaces, where needed, by guides, rollers or other channels, such as rolling flaring or edged cylindrical lace-holders 1731, which may turn about axels 1733, mounted to sole 1709 and/or other contiguous or conjoined structures.

As mentioned above, FIG. 18 illustrates aspects of the same mechanism as that depicted in FIG. 17, but from a side-view, rather than a top-view. From this angle, additional aspects, and the 3-D structure of some of the same structural pieces discussed in FIG. 17, may be better understood. For convenience, parts of FIG. 18 are given the same latter two numbers as the same or similar parts and/or aspects discussed with reference to FIG. 17.

If a user drives member 1803 deeper into channel 1805, lacing 1827 attached to member 1803 tightens as a result. Such lacing may be attached to (and resultantly close) tightening structures holding a biological weight-holding member—in this instance, a foot (not pictured). Such tightening structures may include shoe tongue 1835, which is partially separated from shoe sole 1809 and main shoe body 1810 by an adjustable volume/gap 1837. Greater tightening of lacing 1827 leads to a smaller volume of adjustable volume 1837, and, therefore, a tighter-fit shoe. In addition, a tightness adjusting mechanism, such as that shown as 1839, permits a user to adjust the size of adjustable volume, both when member 1803 is fully seated in channel 1805, and when member 1803 has substantially exited channel 1805.

The shoe tongue mechanism shown in FIG. 18 is by no means exhaustive of the many different mechanism and technique options that may be used to implement aspects of the present invention. In some versions of these aspects, the adjustable volume may be separately defined, regardless of whether platform 1801 is seated in complementary sole depression 1817 locking member 1803 fully into channel 1805. In that embodiment, the adjustable volume would comprise a compartment including a floor as well as sides and a ceiling, leaving only an entry port for entry of the user's foot, which compartment may swivel on a joint near the toe of the shoe downward as member 1803 or, instead, the compartment itself, drives the lacing tighter by attachment to the lacing and a reversible locking mechanism corresponding with the seated position of the compartment (flat with the sole of the shoe). Multiple members, which may be side-mounted rather than centrally mounted, in the shoe or shoe sole, may also, alternatively or in addition, be used, and release buttons or other catch releases may be placed at any accessible point(s) for the user. The member(s) and channel(s) themselves need not take the form(s) shown in FIG. 18 to carry out aspects of the present invention. In addition, they need not use the number and shape of barbs, or barbing at all, as a variable lock and release mechanism, and any other known variable binding or locking mechanism may, alternatively, be used, although the form of member and barbing shown for member 1803 depicted in the figure is preferred. Multiple different lacing and tightness transferring and distributing means may also, or alternatively, be used, in addition to lacing 1827. For example, additional laces may be attached to or otherwise transfer tension from the weight-driven compression of platform 1801 and member 1803, such as the alternative/additional lacing shown in dashed lines as 1891.

Figure 19:
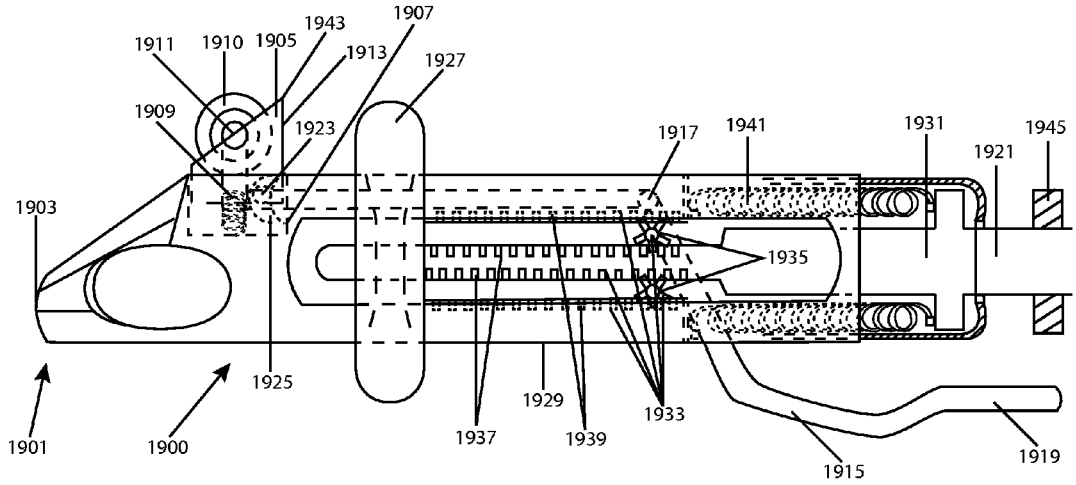
FIG. 19 is a side view, partially in section, illustrating another integrated barbell/clip system, for securing weights to a barbell with active lateral force support, and which also allows the selective rapid release of loaded weights, in accordance with additional aspects of the present invention.

FIG. 19 is a side view, partially in section, illustrating aspects of another integrated barbell/clip system 1900, for securing weights to a barbell with active lateral force support, and which also allows the selective, rapid release of loaded weights, in accordance with additional aspects of the present invention. Although some aspects of the mechanisms shown are exposed to view, for ease of viewing, it should be understood that a fully surrounding jacket may, in practice, conceal various mechanisms and protect against wear, catching foreign objects and user injury. System 1900 comprises one loading end of a weight-bearing member, 1901, such as the end of a barbell. Loading end 1901 is of a 3-dimensional shape that slopes to a narrowed point 1903, preferably with an at least semi-conical, curved slope. This slope facilitates the loading of a weight with a loading aperture or notch (not pictured) onto the loading end 1901. As such a weight is loaded, it may pass over a depressible, one-way pass-facilitating tab 1905. As shown in the figure, tab 1905 is depressible into a channel 1907, against force-biasing 1909, such as a spring, which applies force in the direction of elevating tab 1905. By sliding the aperture of a weight over the loading end 1901, and assuming that that aperture is sufficiently wider than the maximum diameter caused by the semi-conical slope, discussed above, of the loading end 1903 to permit such an aperture to pass, the aperture of the weight will also pass over tab 1905, depressing it into channel 1907 as it passes. A lubricant(s), wheel(s), bearing(s) or other passage facilitating mechanism, structure or technique 1910 may, in addition to the one-way passage facilitating slope 1911, aid in causing the passage of the loading weight aperture, and depression of tab 1905 into channel 1907. Once such a weight and weight aperture have been loaded past the right-hand side of tab 1905 and channel 1907, force-biasing 1909 causes tab 1905 to rise from channel 1907, as it is no longer obstructed by the weight aperture. At that point, side-wall 1913 of tab 1905 prohibits the weight and its aperture from passing back, to the left, and off of the weight-loading member. However, a user may cause tab 1905 to descend into channel 1907 by actuating tab-depressing lever 1915, which pivots about fulcrum 1917 and, when lever handle 1919 is pulled toward handgrip 1921, pulls tab 1905 downward via a preferably pivotable joint or attachment 1923 between tab 1905 and lever 1919. To allow the passage of lever 1919 through at least one wall in channel 1907 to its attachment point(s) 1923, at least one curved opening 1925, which preferably matches or encompasses the arc of motion of the lever attachment point 1923 may be included.

A weight and weight aperture stopping collar or wall 1927, which is preferably force-biased and preferably surrounds the circumference of an outer sheath/loading jacket 1929 of the end of the weight-loading member 1901, is also included and serves to hold any loaded weights and their apertures actively and firmly against side wall 1913 of tab 1905, providing lateral support force from the right due to the force-biasing, and, due to the reacting structural force of tab 1905, left-hand side of the weight. For the force-biasing of wall 1927 to function ideally, it may move, along with a central mounting bar 1931, to which wall 1927 is attached, relative to jacket 1929. Preferably, a bearing or gear arrangement, such as that pictured as 1933, with gears 1935, which interface with both central bar tracks 1937 and sheath/jacket tracks 1939. In this way, force-biasing 1941 may apply force to pull both central bar 1931 toward tab 1905 and the loading end of load-bearing member 1901 and, ipso facto, apply lateral, stabilizing force against a loaded weight (preferably a plate-style weight) that also, when lever 1919 is actuated, will lead to one, and only one, such loaded weight and aperture being shed per a sufficiently isolated pull on lever 1919. After a lever pull, but before a single weight has been thus shed, tab 1905 begins to rise and press against the loading aperture of such a weight and, once the right-hand side edge of that aperture has passed, the point 1943 of tab 1905 will rise along the right-hand side edge of the aperture and weight, provided that there is a sufficient gap (by design or natural tolerance variation) from a neighboring weight and aperture, to the right-hand side. As tab 1905 so rises, to the right of the shed weight and aperture, its slope and passage facilitating mechanism 1910 causes the weight and aperture to be pushed and shed to the left, onto the semi-conical slope of the end of the weight bearing member, and gravity then causes the weight to be completely shed from the weight-bearing member.

As an alternative to the structure shown in FIG. 19, central bar 1931 may be joined to sheath/jacket 1929, but not joined to force biasing 1941, and, instead, collar or wall 1927 may be joined to force-biasing 1941, through slots in sheath/jacket 1929. In this way, the track, bearing or other internal components may be omitted and substituted with such a slot and direct force-loading application. As an advantage, user's fingers may be less susceptible to pinching by sheath/jacket 1929 moving relative to handgrip 1921 and central bar 1931. However, the overall barbell will remain at a fixed length and size, rather than reducing its size, as weight is unloaded in that, alternate configuration. In the structure shown in FIG. 19, hand guards 1945 may aid in reducing the risk of hand pinching.

Figure 20:
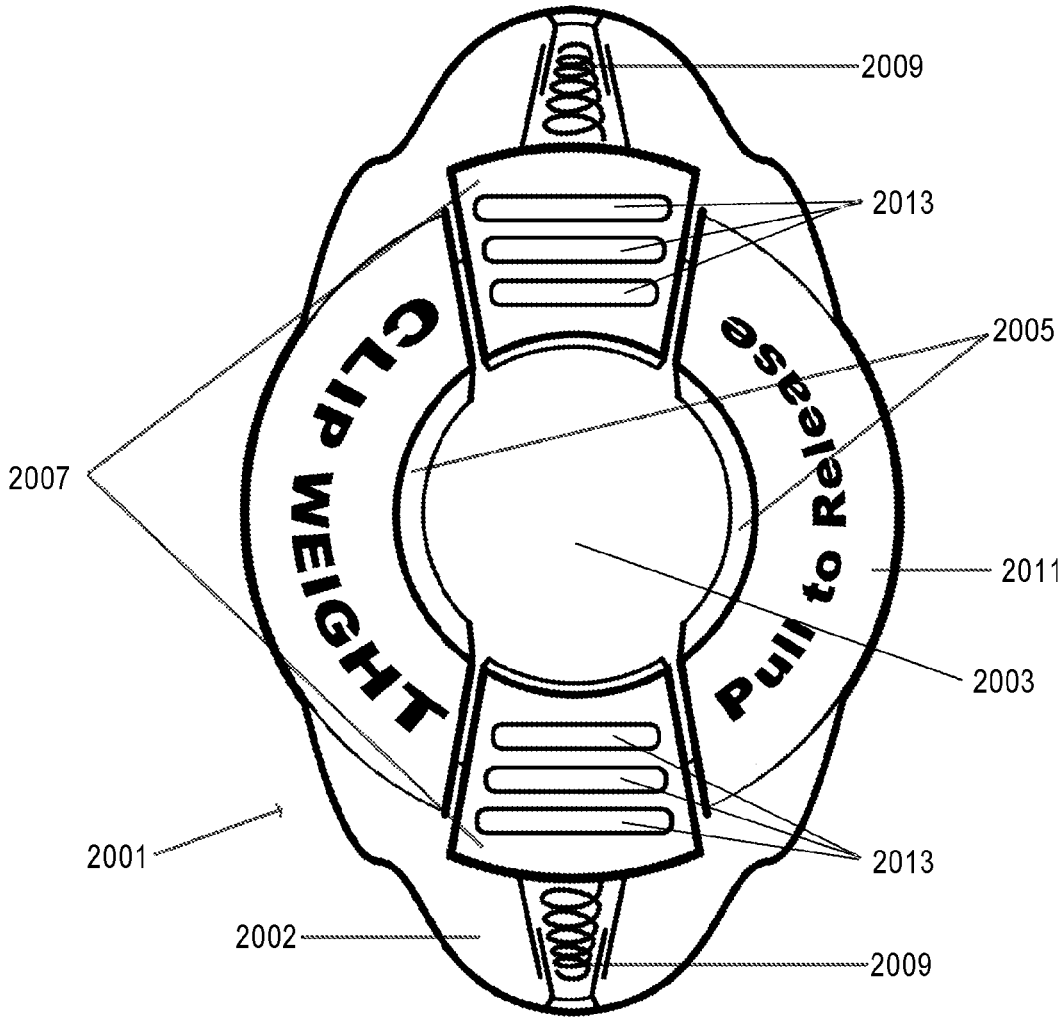
FIG. 20 is a front view of a variably attachable/detachable clip unit of a CLIP-WEIGHT system, with weight-mounting and loading-actuated securing aspects, in accordance with aspects of the present invention.

FIG. 20 is a front view of a variably attachable/detachable clip unit 2001 of a CLIP-WEIGHT system, with weight-mounting and loading-actuated securing aspects, in accordance with aspects of the present invention. As with other CLIP-WEIGHT embodiment aspects discussed in this application, clip unit 2001 may assist in securing plate-style weights onto a weight-loading member, such as, but not limited to, the end of a barbell. A loading aperture 2003 may be threaded over such a member, the aperture 2003 having a complementary, slightly larger cylindrical shape than such a member. In addition, however, the clip unit 2001 may also variably attach to the plate-style weight as well, and clip 2001 may (when so attached) secure itself and the weight to the barbell.

Figure 21:
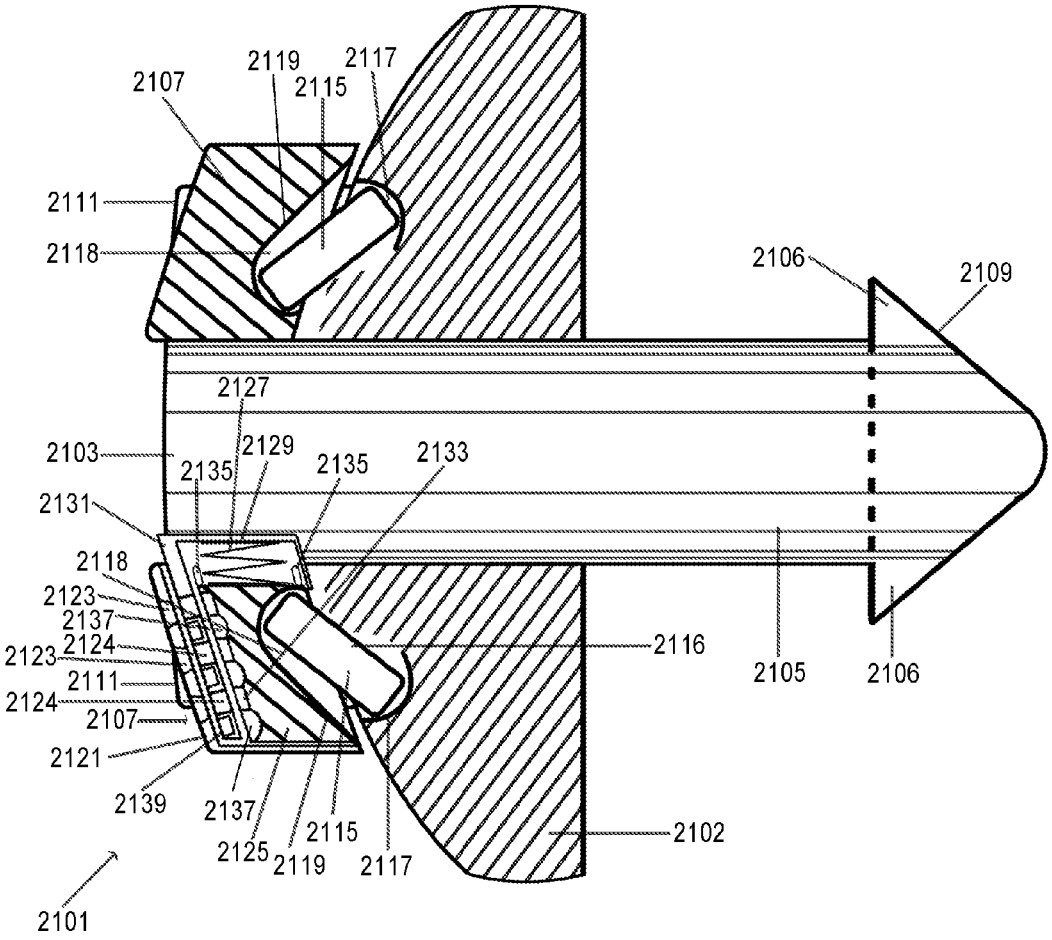
FIG. 21 is side sectional view of a similar clip unit to that discussed with reference to FIG. 20, above.

As will be seen in greater detail with reference to FIG. 21, flexible leaves 2005 of clip unit 2001 may be threaded through (and then reversibly hold clip unit 2001 to) a loading aperture of a weight, such as a plate-style weight, with the aid of flexion-removable barbing (not pictured in FIG. 20, but shown in FIG. 21 as 2106) that may grip an edge of the weight's loading aperture. To secure the then-attached weight onto a weight-loading member, gripping members, such as those shown as 2007, may be user-variably driven inwards, toward the center of aperture 2003, creating locking pressure onto a weight-loading member. To create the tightening force necessary for that locking pressure, user-variable force loading, such as the examples shown as sprung pistons 2009, may be used. Force loading 2009 may be user actuable, applicable and reversible by any means for variable force loading discussed in this application or known in the art—for example, a lever or switch mechanism. But preferably, a specialized depressible and pushable and pullable button/flange 2011 attached to, and able to variably actuate, a weight-locking force applicator mechanism (which may include gripping members 2007) is used. Preferably, such a force applicator may include curved force-redirecting members within channels, which aspects will be discussed in greater detail in reference to FIG. 21. Also preferably, a force-reversible locking mechanism, including, but not limited to, examples with an exceeded balance point for maintaining locking pressure, is used to reversibly maintain button/flange 2011 in a depressed (into the page) locked position, in which it causes members 2007 to exert their own locking pressure onto the bar. But a wide variety of alternative locking and levered pressure, or other pressure, exerting mechanisms may also, or alternatively, be used. When button 2011 is in the locked position, with proper corresponding locking pressure from members 2007 onto a bar, preferably, locking pressure confirming indicators 2013 (which may comprise windows revealing colors corresponding with the proper, force-exerting position of internal force-exertion members and/or force biasing) may also be used to confirm for a user proper locking of the clip unit and attached weight onto the bar.

Using the aspects described above, the clip unit 2001 may begin a use cycle in a position where the button/flange 2011 has been pulled toward the user (out of the page, in the perspective of the figure), causing members 2007 to be in a retracted position, with a relatively wide resulting aperture 2003, permitting the loading and unloading of the clip unit onto a bar. A lip allowing the user's fingers to grip the edge of button/flange 2011 is preferably included. The user may attach clip unit 2001 to the aperture of a weight, although it may already be so attached to a weight that is desired to be loaded, in which case, that step need not be carried out. Following that step, if executed, the clip unit 2001 and attached weight may be loaded onto a weight-loading member (such as the end of a barbell) and slided into its desired loaded position on that weight-loading member (not pictured). At that point, the user may push button/flange 2011 downward (into the page) causing gripping members 2007 to push inward, locking it onto the bar. However, the user need not do so to lock the clip and weight onto the bar if, for example, another weight is then loaded, also onto the weight member, from the side of clip 2001 facing the viewer (out of the page), because, by sliding against button/flange 2011, such a subsequently-loaded weight will cause button 2011 (with its preferred shape and travel profile) to be depressed into a locking position and, in any event, the subsequently-loaded weight may itself have a locking mechanism sufficient to hold both it and the previously-loaded weight onto the bar. To remove clip 2001 and the attached weight, the user may reverse the actions discussed above, pulling button/flange 2011 upwards (out of the page) to loosen gripping member 2007 and pull the clip and weight off of the bar.

FIG. 21 is side sectional view of a similar clip unit to that discussed with reference to FIG. 20, above, and now shown as 2101. From this view, one can see that the frame (now shown as 2102) of the clip unit 2101 helps to define the loading aperture (now shown as 2103), which is approximately cylindrical in shape. Also aiding in defining aperture 2103 are the semi-cylindrical weight-securing flexible leaves (one of which is visible in the side sectional view and now shown as 2105). As discussed above, these leaves are what may be threaded through (and then reversibly hold clip unit 2101 to) a loading aperture of a weight, such as a plate-style weight. In more detail, flexion-movable barbing, now shown as 2106, may grip an edge of the weight's loading aperture, holding the clip unit 2101 and weight together. When threaded onto a weight-loading member, aperture 2103 is substantially fully occupied by the member (the bar). As a result, leaves 2105 may not be flexed substantially inward, and barbing 2106 may not pass through the loading aperture of the weight. However, when not loaded on the bar, such flexion and release of clip unit 2101 may be achieved by pressing the leaves together, and unit 2101 may be decoupled from the weight. It should be noted that leaves 2105 are preferably sufficiently thin (in the sheet thickness of the hollow semi-cylinder formed by each leaf) to pass through standard tolerances between weight apertures and weight-loading members. But, alternatively, custom-sized apertures, bars and leaves may be used that allow for greater thicknesses of coupling leaves or members, such as that shown as 2105. Also preferably, the leaves, such as leaf 2105 are made of a sufficiently resilient yet flexible material to permit repeated inward flexing together and release, while still biasing outward slightly, to pass into the loading aperture of the weight, while pressing outward against it, with the aid of one-way ramps 2109.

Also shown in greater detail in FIG. 21 is one potential, preferred embodiment of aspects of a variable locking mechanism, which may drive the gripping members (now shown as 2107) inward, toward the center of aperture 2103 to lock clip unit 2101 (and any attached weight thereto) onto a bar. Turning force application projections 2115 are pushed through channels 2118 to translate locking actuation (depression of button 2111, toward the right-hand side of the figure) into inward locking pressure of gripping members 2107. More specifically, projections 2115 are curved and the section passing from channel-defining walls 2117 toward channel-defining walls 2119 widens as button 2111 presses them into the visible part of the channel 2118 in the figure. Gripping members 2107 may be held to frame 2102, yet slidable approximately upward and downward, according to such actuation by projections 2115, by any known means, such as sliding flanges.

If the locking pressure status indicator aspects (previously shown as 2013) of the clip unit discussed in reference to FIG. 20 are implemented in unit 2101, an exemplary mechanism for such an indicator is demonstrated in the bottom of the two gripping members (2107). In an embodiment comprising this mechanism, an outer housing 2121 may be fixed to the frame, and may comprise substantially transparent or translucent viewing windows, such as those shown as examples 2123. Instead of directly transferring force to lock clip unit 2101 to a bar, force application projection 2116 presses against an intermediate block 2125 which, via a compressible connecting member (such as spring 2127), travels toward and applies sufficient pressure to (until colliding against the upward edge 2129) final drive box 2131, which is attached to, but slidable upward along, frame 2121 and 2102, to create desired binding or securing pressure between unit 2101 and a bar. Additional substantially transparent or translucent windows 2124 are also present in final drive box 2131. Prior to any such application of pressure (from 2115 or 2129), spring 2127 is fully extended (as pictured) and, as a result aligned alert pigment surface sections, such as the example shown as 2133, on intermediate block 2125, exclusively, are visible through windows such as those shown as 2123 and 2124. However, when sufficient pressure to adequately compress spring 2127 has been exerted (as may be partly defined by compression degree determining legs 2135), proper clip deployment pigment sections, such as those shown as 2137, (preferably green in color) become exposed, indicating the proper application of clipping pressure onto a weight-loading member, such as a bar inserted in aperture 2103. If final drive box 2131 does not encounter resistance from a correct size weight-loading member, final drive box 2131 shifts forward, and additional alert indicating pigment sections, such as the example shown as 2139, become exposed, again alerting of that different error in clip deployment. Preferably, the different types of alert pigment sections are of a different, readily distinguishable color.

Figure 22:
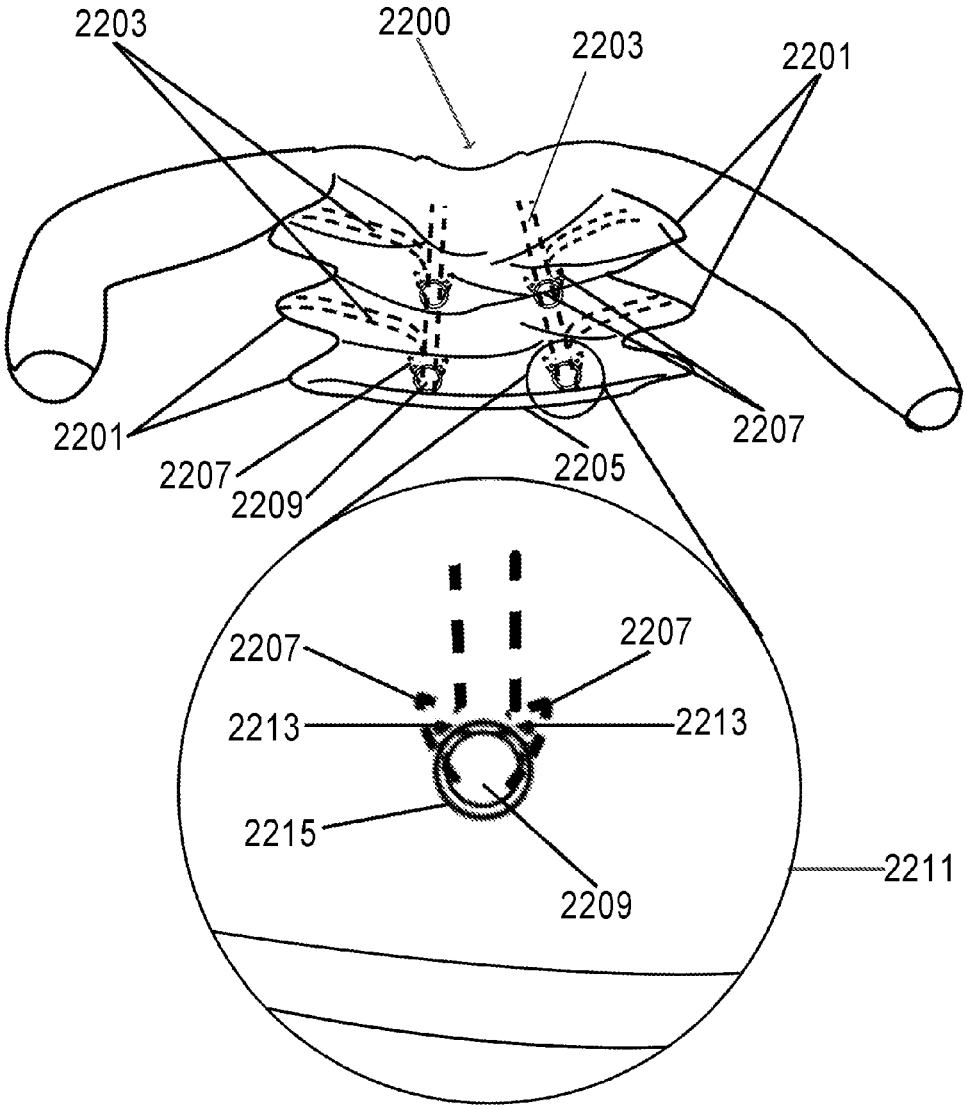
FIG. 22 depicts additional aspects of the present invention, as with some aspects presented with reference to FIGS. 17 and 18, in the context of apparel.

FIG. 22 depicts additional aspects of the present invention—as with some aspects presented with reference to FIGS. 17 and 18, in the context of apparel. A long-sleeved shirt 2200 implementing a garment system according to aspects of the present invention is shown in the figure with a series of approximately pleated folds, such as those shown as 2201. This configuration of the garment system may be thought of as the stored or compressed configuration, and the pleats may be encouraged by inset elastomeric bands or threads (not pictured). However, if so, such elastomeric bands or threads must be light enough in force-loading and pulling strength not to interfere with other variably garment compressing and tightening (or otherwise force-transferring) bands (not pictured) which thread through channels in the fabric. Such channels are shown, for example, as channels, 2203 and such bands may, but need not, have elastomeric properties further encouraging the folding of the garment when a compressed, stored configuration is selected by a user. Such tightening bands are preferably attached at least two end points along the channels 2203 of the garment and, in the compressed state, more length of such tightening bands are held in the channels that are shown which are approximately horizontal (such as those channels 2203 shown on the left-hand side of the figure). As a result, the bottom edge of the garment is pulled upward and the garment is spread wider than in other configurations.

However, after a user dons the garment over his or her head and begins pulling downward on the bottom edge 2205, the tightening bands begin to do their work, emerging from the horizontal channels (such as the left-hand side examples of 2203) as they are pulled into the vertical channels (such as that shown as the right-hand side example of channel

2203). In the process, the garment also naturally gathers in and begins to hug the user and fit his or her torso more tightly, due to the pulling force against the tightening bands. To preserve this tight-fitting configuration, one-way barbs on the bands (not pictured) may enter barb-accepting pockets, such as those pictured as 2207, and the length of the tightening bands taken from the horizontal channels and into the vertical channels will not slide back from this stretched configuration to its original position (the compressed, pleated configuration). However, the user may push a release button, such as that shown as 2209, at any time to release the barbs of the tightening bands, and again allow force transfer band slack to return into the horizontal channels. Zoom window 2211 shows this release mechanism in more detail, which is related, but distinct, from the particular barb releasing buttons discussed with reference to FIGS. 17 and 18, above. Instead of comprising push rods spreading the walls of the channel to eliminate barb-accepting pockets 2207, barb-compressing wedges 2213 instead compress and eliminate any barbs held in pockets 2207 when button 2209 is depressed (pressed into the page) by moving along the outer sides of those pockets 2207.

Although, in examples provided of this invention, locking mechanisms to maintain securing and fitting pressure on garments comprise barbing and barb-accepting pockets, and such mechanisms are preferred, it should be understood that a wide variety of different or additional variable locking mechanisms may be alternatively, or additionally, used, with or without guiding channels, and any other force transfer aspects may also, alternatively or in addition, be used. For example, but by no means exhaustive of the many different buckles, snaps, eyelets, Velcro and countless other variable fasteners that may be used, smooth projections, rather than barbs (and complementary or projection-compressing and holding pockets), that can be overcome with sufficient force, may be preferable in some embodiments, to avoid the risk of damage from overstraining barbing.

I claim:

1. A garment for clothing a user comprising a built-in fitting and fastening system comprising at least one force transfer band adapted for driving the fitting and fastening of said garment on a person, wherein the fitting and fastening system is configured to be actuated and powered by the movement of a structural part comprising an edge of said garment, wherein said movement of at least part of said structural part comprising an edge of said garment during donning causes movement of said at least one force transfer band along a first line, and said movement of said at least one force transfer band along a first line is translated into securing and tightening movement along a second line, leading to pressure between the body of said user on which said garment system is donned and an inner surface of said garment.

2. The garment for clothing a user comprising a built-in fitting and fastening system of claim 1, wherein the system is configured to enable a user to variably set the degree of said securing and tightening movement and said pressure.

3. The garment for clothing a user comprising a built-in fitting and fastening system of claim 1, wherein the system comprises a user-releasable and user-adjustable locking mechanism, and wherein said locking mechanism is configured to select and maintain said securing and tightening movement.

4. The garment for clothing a user comprising a built-in fitting and fastening system of claim 3, wherein said locking mechanism comprises at least one barb-accepting and -retaining pocket(s) within at least one channel, and wherein said at least one force transfer band comprises at least one barb.

5. The garment for clothing a user comprising a built-in fitting and fastening system of claim 3, wherein said system is configured to enable a user to release tension in said at least one band and actuate said locking mechanism with a switch, button or other physical control, which is configured to release a member comprised in said at least one band from member-accepting pockets comprised in said garment.

6. The garment for clothing a user comprising a built-in fitting and fastening system of claim 1, wherein said system comprises a locking mechanism configured to lock in said pressure, if said securing and tightening movement has been carried out, and wherein said system communicates whether said securing and/or tightening movement has been carried out.

7. The garment for clothing a user comprising a built-in fitting and fastening system of claim 2, wherein said system comprises a subsystem configured to apply a substantially constant, ideal force, and wherein said subsystem is configured to be variably set by the user and the system.

8. The garment for clothing a user comprising a built-in fitting and fastening system of claim 7, wherein said subsystem comprises elastomeric or other force-loading.

9. The garment for clothing a user comprising a built-in fitting and fastening system of claim 8, wherein said force-loading comprises at least one spring.

10. The garment for clothing a user comprising a built-in fitting and fastening system of claim 1, wherein said garment comprises pleated folds, and wherein said garment is configured for compression and storage with said pleated folds.

11. The garment for clothing a user comprising a built-in fitting and fastening system of claim 10, wherein said garment is configured for compression and storage with elastomeric threading, set in said garment.

12. The garment for clothing a user comprising a built-in fitting and fastening system of claim 1, wherein said garment comprises channels, and wherein said bands are configured to mediate translation of said movement of at least part of said structural part comprising an edge of said garment into said securing and tightening movement by moving through said channels within said garment.

13. The garment comprising a built-in fitting and fastening system of claim 12, wherein said band(s) or other flexible length(s) of material embedded within and configured to move through channels within said garment are attached to a leading edge of the garment as it is put on a user during donning.

14. The garment for clothing a user comprising a built-in fitting and fastening system of claim 11, wherein said elastomeric threading, comprises force-loading, and is configured to encourage the folding of said garment by pulling on said pleated folds of said garment when said system is released from a donned condition by said user.

15. The garment for clothing a user comprising a built-in fitting and fastening system of claim 3, wherein said garment is configured to be folded at least in part by said system when said locking mechanism is released.

* * * * *